United States Patent [19]

Willans et al.

[11] Patent Number: 4,479,854

[45] Date of Patent: Oct. 30, 1984

[54] METHOD AND APPARATUS FOR STRIPPING CATHODES

[75] Inventors: Robert D. H. Willans; Edward G. Baggio, both of Trail; Harold K. Harper, Montrose; Eric L. Mawer, Fruitvale; Robert E. Manwell; George H. Reeves, both of Trail, all of Canada

[73] Assignee: Cominco Ltd., Vancouver, Canada

[21] Appl. No.: 579,339

[22] Filed: Feb. 13, 1984

[30] Foreign Application Priority Data

Feb. 14, 1983 [CA] Canada ..... 421505

[51] Int. Cl.[3] ..... C25D 1/20; C25D 17/00

[52] U.S. Cl. ..... 204/12; 204/198; 204/279

[58] Field of Search ..... 204/12, 198, 202, 203, 204/204, 205, 208, 226, 281, 279

[56] References Cited

U.S. PATENT DOCUMENTS

| | | | |
|---|---|---|---|
| 1,525,075 | 2/1925 | Hill | 204/208 |
| 1,553,080 | 9/1925 | Hill | 204/226 |
| 3,332,128 | 7/1967 | Mori | 204/208 |
| 3,625,806 | 12/1971 | Wennberg | 204/12 |
| 3,689,396 | 9/1972 | Casagrande | 204/12 |
| 3,847,779 | 11/1974 | Sekine | 204/198 |
| 3,935,091 | 1/1976 | Rautimo | 204/281 |
| 3,950,232 | 4/1976 | Nightingale | 204/12 |
| 3,953,312 | 4/1976 | Kikkawa | 204/12 |
| 3,980,548 | 9/1976 | Sekine | 204/297 R |
| 4,137,130 | 1/1979 | Willans | 204/281 |

*Primary Examiner*—Thomas Tufariello

*Attorney, Agent, or Firm*—Arne I. Fors; Robert F. Delbridge

[57] ABSTRACT

A method and apparatus for conveying and stripping electro-deposited metal sheets from cathode plates. A plurality of stations including a feed station, initial horizontal parting station, main vertical stripping station, replacement station, and discharge station are sequentially arranged within the stripping apparatus and cathode plates having metal sheet deposits thereon are conveyed through the apparatus by means of a reciprocating transfer carriage in combination with supporting slide bars and indexing means.

Metal sheet deposits are stripped in a fast, simple and efficient manner by using closed entry horizontal knives to effect initial parting of each deposit and vertical stripping knives to remove the deposits from the two sides of the cathode plate without clamping of the cathode plate while controlling cathode plate sway. Liberated metal sheets are quickly removed from the apparatus and stripped cathode plates are conveyed from the apparatus at a discharge station.

31 Claims, 20 Drawing Figures

METHOD AND APPARATUS FOR STRIPPING CATHODES

BACKGROUND OF THE INVENTION

This invention relates to the electrolytic recovery of metals and, more particularly, is directed to the stripping of electrolytic metal deposits as sheets from cathode plate base plates.

In the electrolytic recovery of metals, such as zinc and copper, high quality metal is deposited on electrode plates such as mother plates, starting sheets or base plates, referred to hereinafter as cathode plates, which are made of suitable materials such as aluminum, stainless steel, or titanium. After a period of electro-deposition of metal on the cathode plates, the cathode plates are removed from the electrolytic cells and subjected to a mechanical stripping or peeling operation to remove sheets of refined metal from the cathode plates which are then returned to the cells.

PRIOR ART

The various mechanized methods and apparatus to facilitate the removal of metal deposits from cathode plates include alone or in combination, the use of impacting, pneumatic or hydraulic spray devices, suction cups, rolling, mangling or bending of the cathode plates and separating knives or wedges.

One of the more prevalent methods and apparatus includes the use of knives or wedges. The use of knives or wedges in combination with one or more of the other methods noted above is disclosed, for example, in U.S. Pat. Nos. 3,332,128; 3,935,091; 3,950,232; 3,953,312; and Canadian Pat. No. 1,016,497. Some methods and apparatus are based on the sole use of one or more knives alone or in one or more pairs to separate the metal deposit from the cathode plate, such as disclosed in U.S. Pat. Nos. 1,525,075; 1,553,080; 3,625,806; 3,689,396; 3,847,779; 3,980,548; and 4,137,130. More specifically, U.S. Pat. No. 3,689,396 discloses an apparatus for vertically advancing cathode plates having a movable guard piece at one lateral edge of the cathode plate, means for moving the guard piece, a wedge shiftable relative to the zone at the guard piece to peel the upper edge of the deposit and a vertically moving blade to deflect the deposit from the cathode plate. According to U.S. Pat. Nos. 3,847,779 and 3,980,548 there are disclosed a method and an apparatus including a multiple station stripping unit having means to pivot a cathode plate holder (guard piece) having tapered surfaces for providing an upturned edge of deposited metal and including an enlarged portion adapted to be engaged for pivoting; means for inserting horizontal stripping knives which clamp onto the exposed plate and partially separate the deposit; and means for inserting main stripping blades and moving the inserted blades downwardly to complete the separation, the cathode plates being secured in each station. In connection with these patents, German Pat. No. 512,913 must be noted. This patent shows a removable edge stick with tapered faces which, upon removal of the edge stick from the electrode, leaves V-shaped grooves between deposits and base plate suited for inserting a stripping tool. According to U.S. Pat. No. 4,137,130, a single movement of a unitary stripping means causes a wedge to be inserted in a V-shaped groove between the cathode plate and the deposit and a blade propagates the separation.

In the operation of conventional stripping machines, each cathode plate is clamped in a stationary position and the cathode plate edge is approached by a pair of knives which are open to ensure that the knives locate on each side of the cathode plate. The knives are stopped or slowed down, closed onto the cathode plate and then advanced for entering between the deposits and the cathode plate to commence stripping. This procedure is time consuming.

In order for the knives to be able to close onto the cathode plate, the removed guard piece must expose an area of the cathode plate surface wider than that normally provided by the standard edge stick. This requires that the guard piece is wider than the edge stick and causes an increased invasion of the guard piece into the anode-cathode plate electric field which results in plating of metal onto the bevelled or tapered edges of the guard piece, often continuing onto the main body of the guard piece. This extended deposition causes undesirable encrustations which can cause electrical shorting, breaking of the guard piece when it is pivoted out of the way, as well as interference with the movement of the knives. The knives not only can be prevented from landing on the cathode plate but can also miss one side of the cathode plate altogether.

The clamping or closing of the knives onto the cathode plate causes gouging on the cathode plate surfaces which leads to increased corrosion resulting in further damage to the surfaces, difficulties in stripping and shortened cathode plate life.

Most stripping machines use either a chain conveyor or a walking beam in order to transfer the cathode plates through the stripping machine. These structures have serious drawbacks; a chain drive has a return section which interferes with the stripping knives and a walking beam is undesirably slow.

STATEMENT OF INVENTION

It has been found that the disadvantages of prior art apparatus can be substantially alleviated and the stripping of metal sheet deposits from cathode plates can be accomplished in a fast, simple and efficient manner by using a closed entry horizontal knife to effect initial parting of each deposit while partly outwardly bending the top portion of the deposit and then removing the deposits from the two sides of the cathode plate with vertical stripping knives without clamping of the cathode plate while controlling cathode plate sway. By providing a guard piece on the cathode plate edge with the same profile and width of and interlocked with the permanent edge stick, interference in the cathode plate-anode electric field and undesirable metal growths are eliminated. By using a closed entry knife to effect the initial parting of the deposit from the cathode plate and by the elimination of clamping of the cathode plates at the knives while controlling cathode plate sway, the time required to effect stripping can be shortened. By providing means to bend the deposits by the horizontally moving entry knives when the entry knives enter between the deposits and the cathode plate, the vertically moving main stripping knives can quickly and reliably remove the deposits from the cathode plate without stopping, thereby further reducing the stripping time. A simple transfer mechanism for advancing cathode plates through the stripping machine still further reduces stripping time.

Accordingly, there is provided a method for stripping electro-deposited sheets of metal from cathode plates used in tne electrolytic recovery of metals, each cathode plate having a head bar at one end for vertical support of the cathode plate, opposite side faces with metal deposits thereon, and vertical side edges having edge sticks mounted thereon and a pivotal guard piece forming a separate upper portion of one of said edge sticks, said method comprising: advancing said cathode plates crosswise to the direction of travel sequentially through a plurality of equispaced stations in succession by means of a reciprocating transfer carriage, said plurality of stations consisting of a feed station, an initial horizontal parting station, a main vertical stripping station, and a discharge station; said transfer carriage mounted for horizontal reciprocal travel above a pair of parallel, spaced-apart slide bars over a distance equal to the distance between a pair of adjacent stations, said transfer carriage having means formed thereon for engaging a cathode plate head bar at each station for advance of the cathode plates on the slide bars to a successive station; actuating detent means operable into and out of engagement with the opposite side edges of the cathode plates at the initial horizontal parting station and vertical stripping station for positioning the cathode plates and preventing sway of said cathode plates at each of the said stations; pivoting said guard piece upwardly away from the side edge of the cathode plate; initially parting the top edge of the metal deposit on each side face of the cathode plate from the cathode plate and bending the said top edges outwardly away from the cathode plate to form a gap between the top edges and the face of the cathode plate at the initial horizontal parting station; vertically reciprocating main stripping knives to engage the deposited metal at the gap on each side face of the cathode plate and strip metal deposits downwardly from each side face of the cathode plate for removal of the said metal deposits therefrom at the vertical stripping station; and removing stripped cathode plates at the discharge station.

The method may include the additional step of positioning the cathode plate and preventing sway thereof while pivoting the guard piece onto the vertical side edge to form the separate upper position of the one edge stick at a replacement station after stripping of the cathode plate.

The apparatus of the invention for stripping electrodeposited sheets of metal from cathode plates comprises in combination: a frame having a plurality of equispaced stations therein; means for advancing said cathode plates crosswise to the direction of travel sequentially through the plurality of equispaced stations in succession, said plurality of stations consisting of a feed station, an initial horizontal parting station, a main vertical stripping station, and a discharge station, said advancing means comprising a pair of parallel spaced-apart slide bars for supporting the head bars of cathode plates; a transfer carriage mounted above said slide bars for horizontal reciprocal travel over a distance equal to the distance between a pair of adjacent stations, said transfer carriage having means formed thereon for engaging a cathode plate head bar at each station for advance of the cathode plates on the slide bars to a successive station, said advance extending substantially the distance between two adjacent stations during reciprocal travel of said carriage; detent means operable into and out of engagement with the opposite side edges of the cathode plates at each of said vertical stripping and horizontal parting stations, for positioning the cathode plates and preventing sway of said cathode plates at each of the said stations; means for pivoting said guard piece upwardly away from the side edge of the cathode plate; means horizontally reciprocal adapted to extend across said cathode plate for initially parting the top edge of the metal deposit on each side face of the cathode plate from the cathode plate and for bending the top edges outwardly away from the cathode plate to form a gap between the top edges and the faces of the cathode plate; means at the main vertical stripping station vertically reciprocal for engaging the deposited metal at the gap on each side face of the cathode plate and for stripping metal deposits downwardly from each side face of the cathode plate for removal therefrom; and conveyor means for removing cathode plates and deposits at the discharge station.

Preferably means are provided at a replacement station for pivoting said guard piece onto the vertical side edge to form the separate upper portion of the one edge stick while positioning the cathode plate and preventing sway thereof prior to transfer onto the conveyor means for removal of stripped cathode plates at the discharge station.

BRIEF DESCRIPTION OF THE DRAWINGS

The invention will now be described in detail with reference to the accompanying drawings wherein.

DETAILED DESCRIPTION OF THE PREFERRED EMBODIMENT

Figure 1:
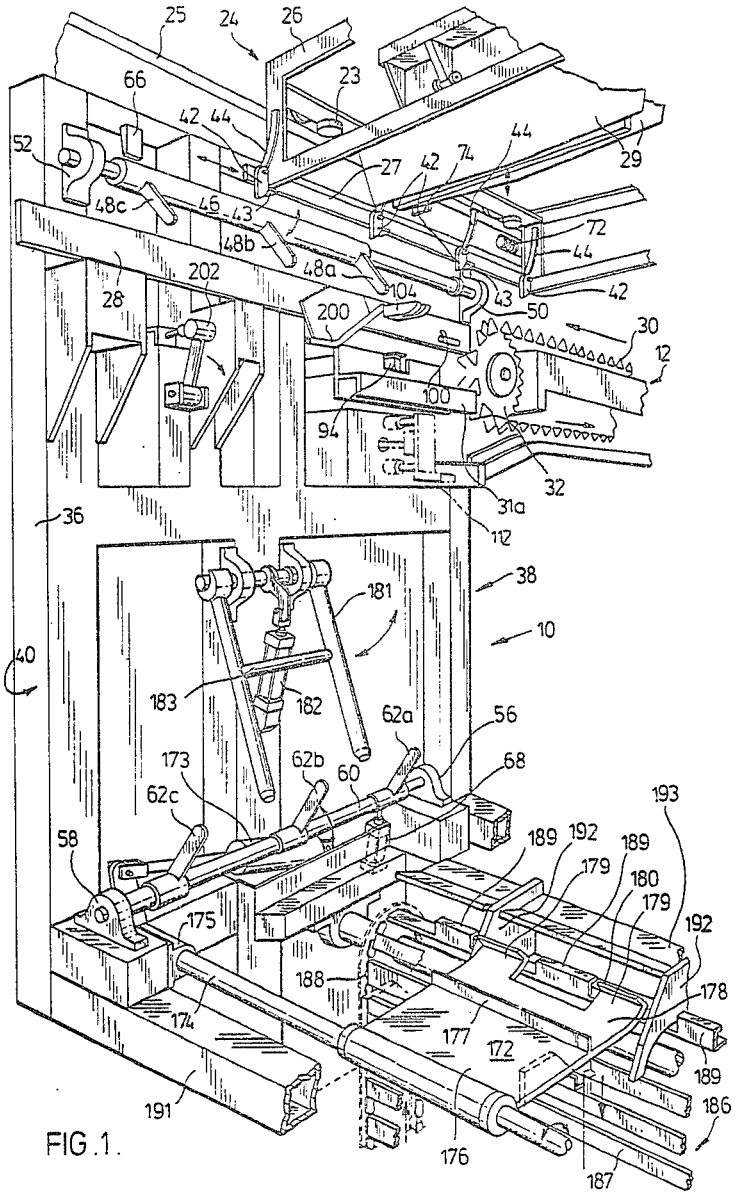
FIG. 1 is a perspective view of the stripping apparatus of the present invention showing the components in their retracted positions.

With reference to the drawings and particularly FIGS. 1–5, the apparatus for stripping metal deposits from cathode plates generally comprises the machine depicted by numeral 10 which is in-line with a conveyor 12 for feeding cathode plates 14 sequentially thereto and a conveyor 16 for conveying stripped cathode plates from the said machine. Cathode plates 14 having head bars 18 and metal deposits on side faces 20, 22 are transferred from feed conveyor 12 by a transfer mechanism 24, comprising reciprocating transfer carriage 26, onto a pair of spaced-apart parallel, fixed slide bars 28. Transfer carriage 26 has rollers 23 provided thereon adapted to co-act with carriage rail 25 secured to frame 36. Piston-cylinder means 70 (FIGS. 2 and 3) are provided between carriage 26 and frame 36 for advancing and retracting the carriage in guided, horizontal travel. The feed conveyor 12 comprises a pair of continuously moving conventional endless chain conveyors 30 passing over sprocket wheels 32 in proximity to each of slide bars 28, one of which is shown in FIG. 1. By keeping the chain conveyor 30 moving continuously at a slow speed, the risk of initiating swing in the cathode plates is reduced. The speed of the conveyor is adjusted to suit the duration of the stripping cycle, to be described.

The cathode plates are intermittently advanced by the reciprocating carriage 26 over the slide bars 28 from a feed station A through an initial parting station B, which comprises means to remove a cathode plate guard piece, and a horizontal, initial parting, closed entry knife 94; a main stripping station C, which comprises vertical main stripping knives 29 which complete the stripping of the deposits; and a cathode plate guard replacement station D. The stripped cathode plates are then moved by the carriage 26 from the slide bars 28 onto a transverse conveyor 16 at a pick-up station E for passing the cathode plates to a subsequent operation or returning the cathode plates to the electrolytic process.

The success of the stripping machine of the present invention is achieved in part by the simple, quick and accurate method in which the cathode plates are moved from one station to another by the transfer mechanism and by the rapid separation and removal of metal deposits from the cathode plates.

CATHODE TRANSFER MECHANISM

Figure 4:
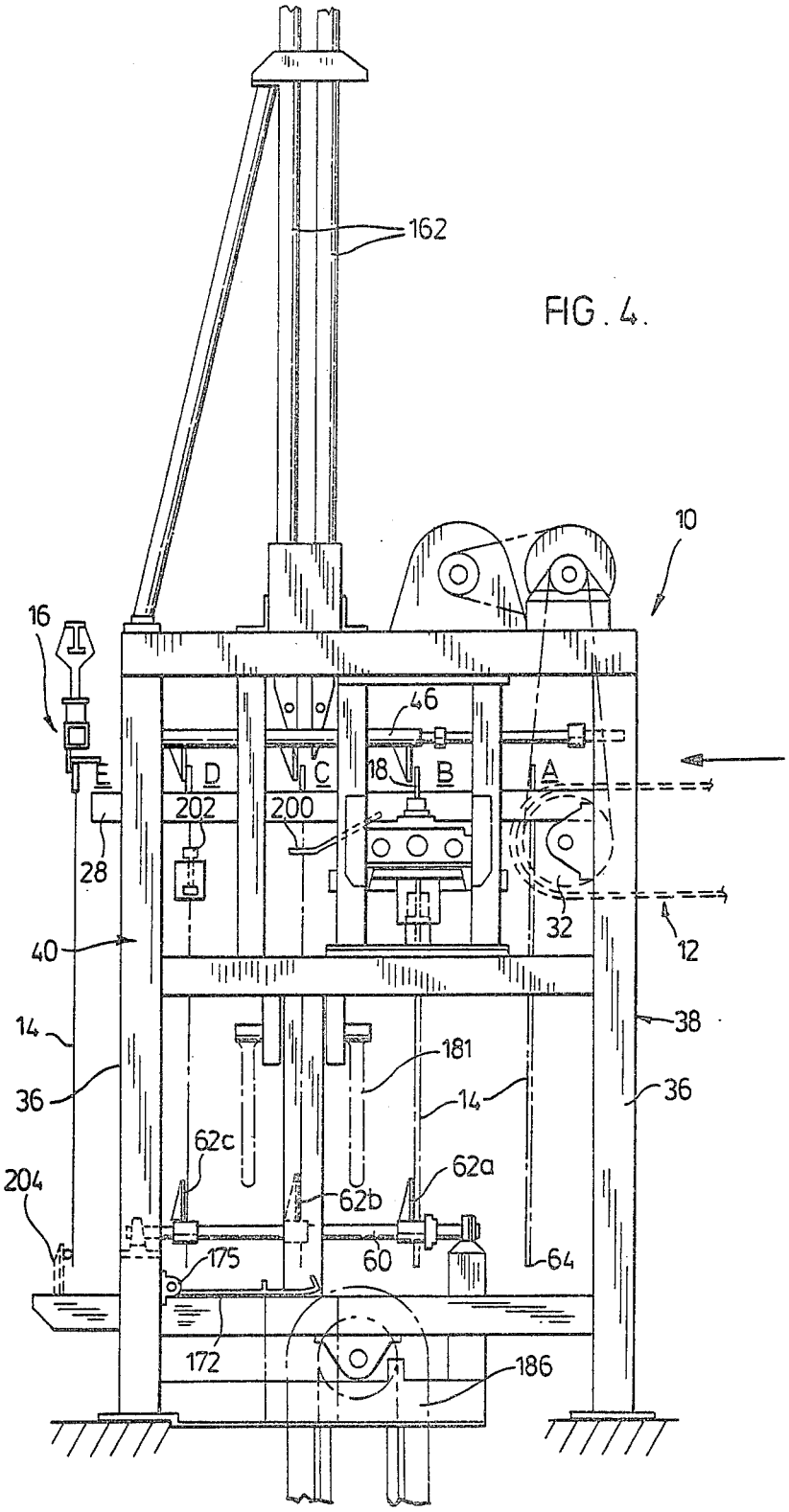
FIG. 4 is a side elevation of the stripping apparatus.
Figure 5:
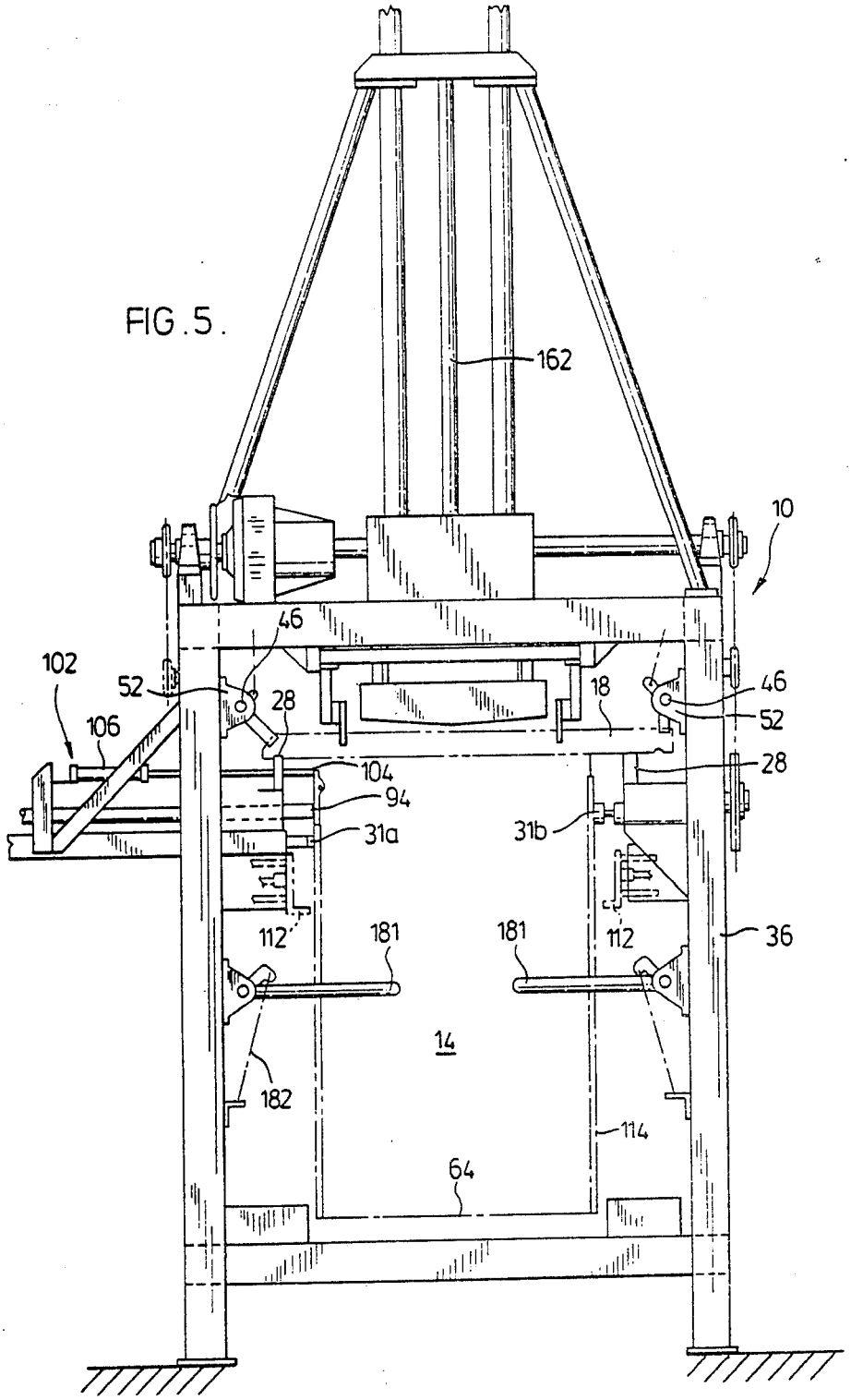
FIG. 5 is an end elevation of the stripping apparatus.

With particular reference now to FIGS. 1, 4 and 5, the pair of spaced-apart, parallel, fixed slide bars 28 are secured, one on each side, to the interior of frame 36 of the stripping machine and extend horizontally from sprocket wheel 32 at one end 38 of frame 36 in alignment with chain conveyor 30 to project beyond the opposite end 40 of frame 36. The thin slide bars 28 occupy little space and present no interference in either the initial parting station B or the main stripping station C to the stripping of the cathode plates.

Figure 2:
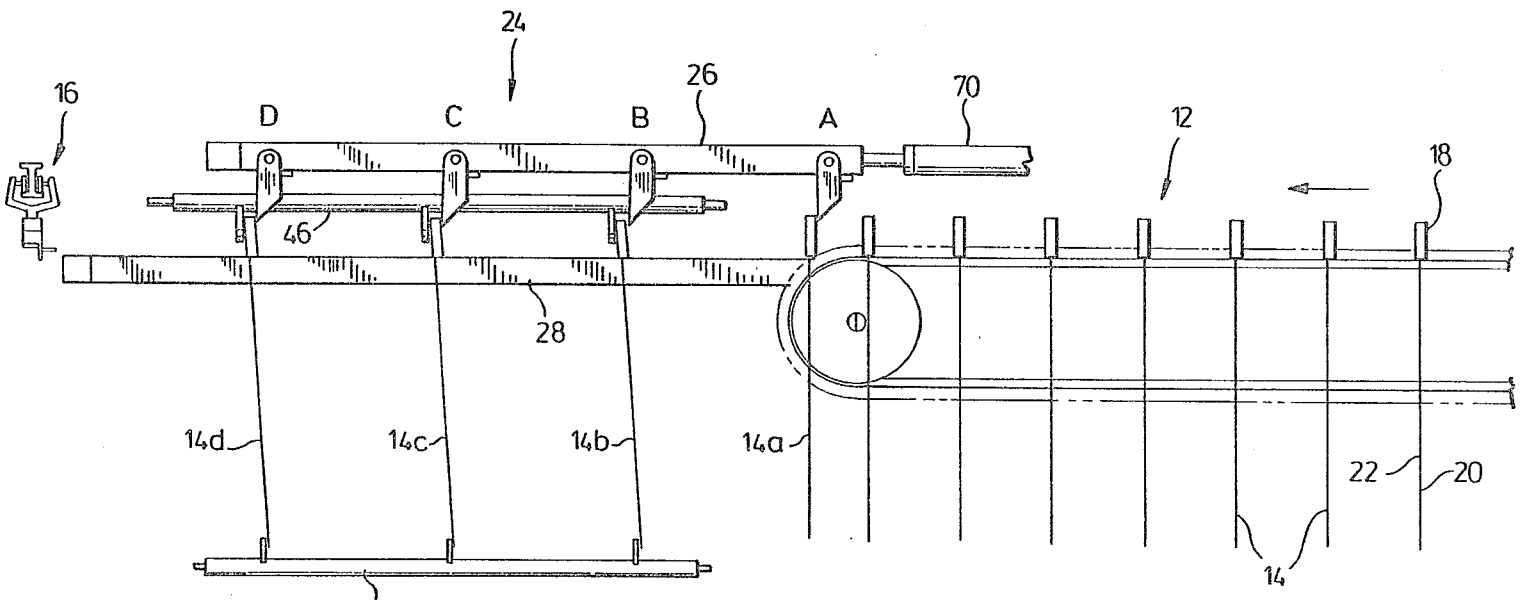
FIG. 2 schematically shows the operative stations and the position of the transfer carriage within the stripping apparatus immediately prior to a transfer of cathode plates from one station to the next station.
Figure 3:
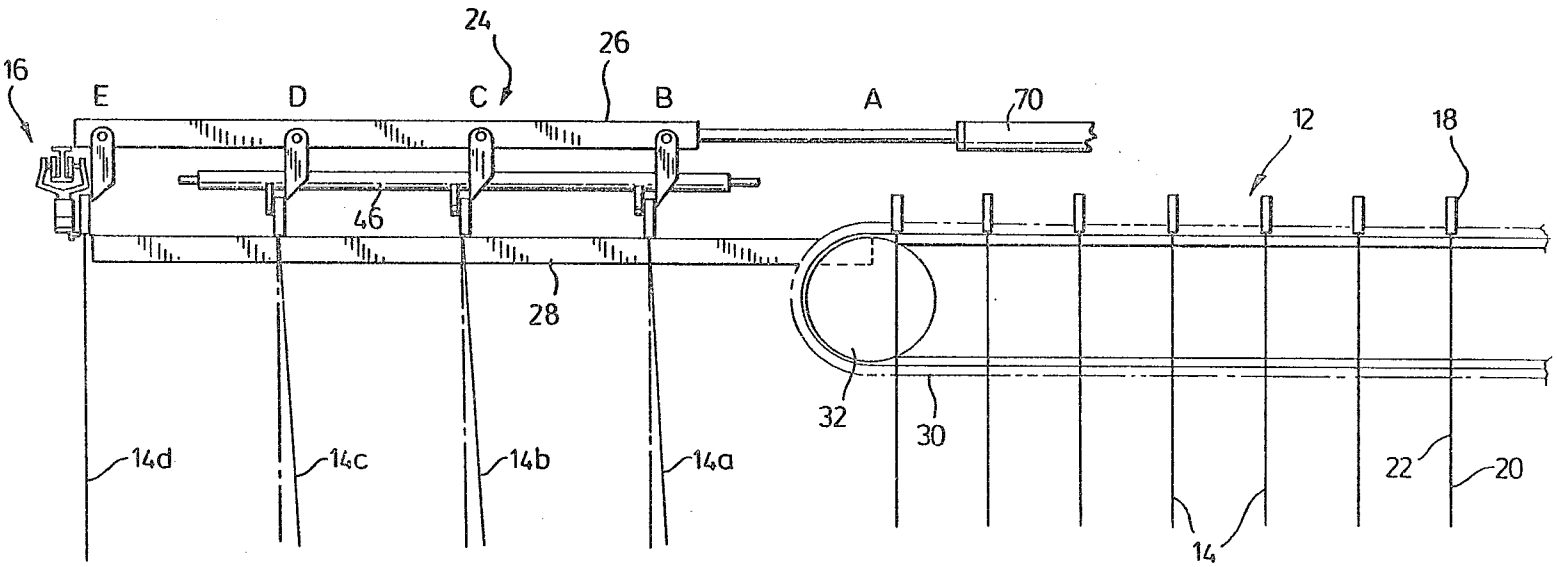
FIG. 3 schematically shows the position of the transfer carriage and placement of cathode plates immediately after a transfer of cathode plates as the transfer carriage begins the return cycle.

Four partly rotatable, equispaced pawls or dogs 42, which are pivotally mounted on each side of the interior of the stripping machine on reciprocatable transfer carriage 26, depend downwardly from horizontal side members 27 towards each cathode plate head bar. The rotation of dogs 42 is limited by stops 43 on the frame of carriage 26 such that the dogs can advance cathode plates to the next station when carriage 26 advances and the dogs can pivot and move over the top of cathode plate head bars when carriage 26 is retracted to its starting position. A spring 44 on each of the dogs 42 pushes the dogs against stops 43 preventing the dogs from remaining in an elevated position. Each dog engages and pushes the head bar 18 of a cathode plate 14, shown by ghost lines in FIGS. 4 and 5, on the fixed slide bars 28 from one station to the next station. The transfer carriage 26 moves a set of four cathode plates with each reciprocation; a set of cathode plates comprising one cathode plate **14*a* moved from conveyor 12 onto slide bars 28 at the feed station A, a cathode plate 14*b* at the intiial parting station B, a cathode plate 14*c* at the main stripping station C and a cathode plate 14*d* at the replacement station D (FIG. 2). When reciprocating, the transfer carriage 26 advances by means of the dogs 42 a set of cathode plates forward to the next successive station, moving the first cathode plate 14*a* from station A to station B and the last cathode plate 14*d* at station D from the slide bars 28 onto conveyor 16 (FIG. 3). The cathode plates are laterally guided by fixed guides 31*a* and 31*b* secured to the interior of frame 36, one on each side. Both guides extend horizontally from sprocket wheel 32 at end 38 of frame 36, guide 31*a* to just past main stripping station C (FIG. 1) and guide 31*b* (FIG. 5) to end 40 of frame 36. Both guides are positioned inside and below the slide bars 28 such that the guides are close to the vertical cathode plate edges. Guides 31*a* and 31*b* provide lateral guidance and centering of the cathode plates when they are moved over the slide bars 28. Guide 31*b* also provides a counterface when horizontal knives 94** move onto the cathode plate surfaces.

An upper shaft 46, one on each side of frame 36, with three equispaced detents **48*a*, 48*b* and 48*c* projecting laterally therefrom, is mounted for rotation in journals 50, 52 above each slide rail 28. A corresponding shaft 60 with three equispaced, laterally projecting detents 62*a*, 62*b* and 62*c* is mounted for rotation in journals 56, 58 just above the plane of the bottom edge 64 of cathode plates 14 (FIG. 4) at each side of frame 36 below upper shafts 46. Lower detents 62*a*, 62*b* and 62*c* corresponding to upper detents 48*a*, 48*b* and 48*c* are spaced along tne shafts from each other the same distance as the distance between the initial parting station B and the main stripping station C. The detents are lined up so that, when the shafts 46 and 60 are rotated by piston-cylinder assemblies 66, 68, the detents locate and engage the cathode plate head bars and bottom edges at the initial parting station B, the main stripping station C and the replacement station D. Upper detents 48*a*, 48*b* and 48*c* are aligned to position a cathode plate accurately at each of these stations. Because the transfer carriage 26 with dogs 42 only pushes the tops of the cathode plates 14, the bottom edges of the cathode plates are delayed in forward travel by detents 62*a* , 62*b* and 62*c*. If the bottom edges were not restrained, the lower portions of the cathode plates would continue travelling after the tops have been stopped. This would cause considerable cathode plate sway which cannot be prevented by holding the cathode plate head bars against the upper detents 48*a*, 48*b* and 48*c* with dogs 42**.

To prevent cathode plate sway, lower detents **62*a*, 62*b* and 62*c* are introduced into each cathode plate path closer to the oncoming cathode plate than the corresponding upper detents so that the bottom edges of the cathode plates will rest against the detents by gravity rather than bounce back and forth against the detents. For very fast transfer of the cathodes plates, the lower detents 62 preferably have a damping device (not shown) such as, for example, a spring or a rubber buffer on the face of each lower detent which will contact the cathode plate to prevent the plate from bouncing. As described above, lateral cathode plate movement is limited by guides 31***a* and 31*b*.

Thus, when a cathode plate 14 is delivered to the starting point on the fixed slide bars 28 in feed station A by chain conveyor 30, the dogs 42 of carriage 26 pass over head bar 18 to engage the rear side of the head bar. While this occurs, the detents on shafts 46 and 60 remain swung out of the path of the cathode plates. As soon as the transfer carriage 26 from which the dogs depend is pushed forward by the actuation of piston-cylinder assembly 70 (FIG. 2) secured thereto, shafts 46, 60 rotate to swing the detents depending therefrom into the path of the cathode plates. Just before the cathode plates reach the upper detents a shock absorber 72 mounted on carriage 26 abuts a stop 74 on the main frame 36 of the stripping machine (FIG. 1). The shock absorber decelerates the cathode plates and cushions the impact while permitting maintenance of pressure on the head bars 18 so that they are held in place and are prevented from bouncing or swinging when they are subsequently contacted by the parting knives and the main stripping knives, to be described. The detents are installed on the machine such that the cathode plate head bar 18 in main stripping station C in particular is aligned perfectly with the main stripping knives. The vertical, main stripping knives depicted by numeral 29 are sensitive to the position of the cathode plate and also to the amount or degree of sway. If the cathode plate is not accurately positioned at the station or if it is swinging at the time of actuation of the knives, one knife may land on top of the head bar and stripping will not occur on one side of the cathode plate. This leads to cathode plate bending by the knife on the side being stripped. It is, therefore important that dogs 42 of the transfer carriage 26 and the top detents 48*b* are aligned accurately with the vertical main stripping knives 29. A small tolerance in alignment can be accepted for the cathode plate at the initial parting station B because the initial parting knife 94 will be guided in its travel and is flexible enough to absorb some misalignment and even a minor amount of sway.

The detents 48*b* and the corresponding dogs 42 remain in position to hold cathode plate 14 therebetween until the main stripping knives, to be described, in the main stripping station C have completed their downward stroke. As soon as the stroke is completed, the transfer carriage 26 with dogs 42 is retracted to its starting position, (FIG. 2), the dogs 42 pivoting and lifting over the cathode plate head bars 18 on the return travel while the upper and lower detents are moved out of the path of travel of the cathode plates by rotation of shafts 46, 60.

The movement of the transfer carriage 26 from its starting position as shown in FIG. 2 to its forward position as shown in FIG. 3, moving a set of cathode plates from one station to the next, takes about 1½ seconds. At about one-half second after the transfer carriage initiates forward movement, the three upper detents 48*a*, 48*b* and 48*c*, and the three lower detents 62*a*, 62*b* and 62*c*, move into the path of the cathodes plates.

THE INITIAL PARTING STATION B

With reference now to FIGS. 6–9, two main functions occur at the initial parting station B:

1. The guard piece 90 on one of the vertical edges 92 of a cathode plate is rotated to a horizontal position; the completion of rotation being checked by a sensor 100 (FIG. 1); and
2. The closed entry, initial parting knives 94 enter horizontally onto the cathode plate 14 to effect the initial parting of the metal sheet deposits 96, one of which is shown, and to bend the deposits outwardly at the top portion 98 to permit easy access for the vertical main stripping knives 29.

In more detail, as soon as the cathode plate 14 arrives at the initial parting station B, the guard piece removal mechanism 102 having forked extension 104 adapted to span the thickness of cathode plate 14 is extended by hydraulic piston-cylinder assembly 106 to abut the top portion 108 of pivotally mounted guard piece 90 to rotate and raise body 110 of the guard piece 90 from the cathode plate edge 92 into a substantially horizontal position so that the initial parting knives 94 can engage the cathode plate. A sensor 100 checks that the pivoting of the guard piece into a substantially horizontal position has been completed. If the pivoting has not been completed, the horizontal parting knives 94 are prevented from extending.

The guard piece 90 is designed with the same profile as the edge stick 114, thus avoiding any wings and peanut-like encrustations on the metal sheet deposits 96 formed during electrolysis. In addition, the bottom of body 110 of the guard piece 90 interlocks with the top 115 of the fixed edge stick 114 by means of a slight interference fit. This prevents the guard piece 90 from floating away from the cathode plate 14 when it is submerged in the electrolyte.

After the guard piece 90 is raised, the closed entry, horizontally moving, initial parting knives 94 are extended by a piston-cylinder assembly, not shown, and are moved onto the cathode plate to part the deposits 96 from the cathode plate faces across the upper portion of the cathode plate at the tops 98 of the deposits.

Figure 9:
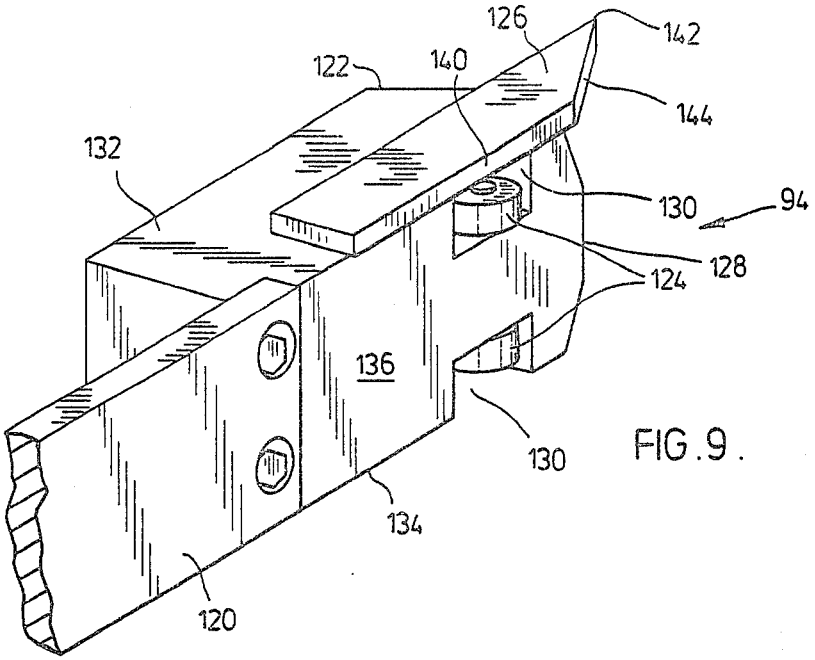
FIG. 9 shows an enlarged detail of the closed entry, initial parting knife illustrated in FIG. 7.
Figure 6:
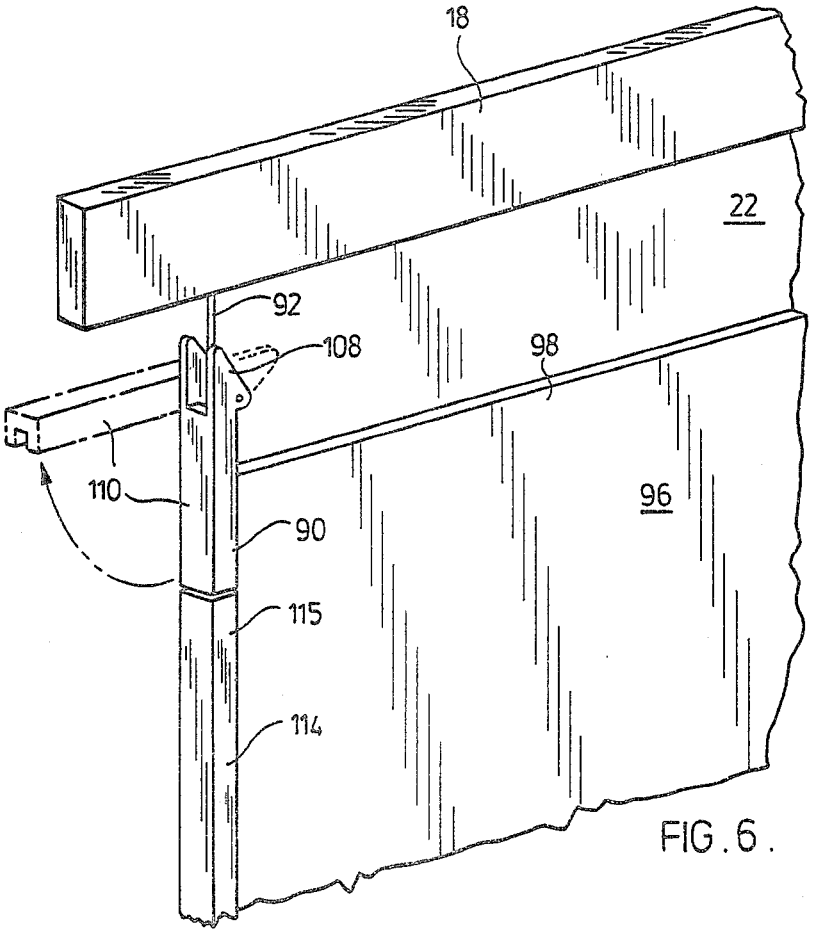
FIG. 6 is a perspective view of an upper portion of a cathode plate.

The initial parting knives 94 are horizontally moving, closed entry knives which comprise two interdependent components each composed of a leaf spring 120 attached to a common cross-head support (not shown) and individual nosepieces 122, rollers 124 and guide horns 126, shown most clearly in FIG. 9. The nosepieces 122 have a sharp leading edge 128 with which to penetrate between the deposit 96 and adjacent cathode plate face. Two rollers 124 are journalled into laterally-spaced recesses 130 in each nosepiece 122 at upper and lower faces 132, 134 of the nosepiece 122 such that the rollers 124 slightly protrude above the inner sliding faces 136 of the nosepieces.

The rollers 124 prevent the steel nosepieces 122 from galling or scratching the cathode plate surfaces 20,22. The guide horns 126 are mounted onto the top face 132 of each nosepiece 122, their inner surfaces 140 being flush with the inner surfaces 136, i.e. facing surfaces, of the nosepieces 122. The guide horns 126 have a leading edge 142 and a bevelled edge 144 such that a V-shaped opening 146 is defined between the guide horns 126, FIG. 7. The guide horns 126 ride on the cathode plate faces 20,22 above the tops of the deposits 96. Their purpose is to align the nosepiece 122 with the cathode plate 14 so that the leading edge 128 of each nosepiece 122 misses the cathode edge 92 and enters between the deposit 96 and the adjacent cathode plate face 22.

The leaf springs 120 of the closed entry knives bias and maintain the two nosepieces 122 against the faces 20,22 of the cathode plate as the knives engage the cathode plate, enabling the nosepieces 122 to straddle the cathode plate and enter behind the deposits 96. In addition, the springs 120 provide sufficient flexibility to allow each nosepiece 122 to ride on the cathode plate 14 if the nosepiece should fail to penetrate and enter under the deposit 96 and thus be deflected to the outside of the deposit.

The closed entry, initial parting knives 94 are assembled such that the leaf springs 120 keep the rollers 124 in the nosepieces 122 in contact with each other. Upon moving forward, the guide horns 126 separate the nosepieces 122 when the bottom of the V-shaped opening 146 between bevelled edges 144 reaches the edge 92 of the cathode plate 14, so that the leading edges 128 miss the cathode plate 14 and the nosepieces 122 can enter between the deposits 96 and the cathode plate 14. As soon as entry is made, the rollers 124 approach and reach the cathode plate edge 92 and roll onto the cathode plate surfaces 20,22. The leading edges 128 of the nosepieces 122 are consequently lifted slightly off the cathode plate surfaces 20,22 preventing scratching or galling of the surface metal.

The design of the initial parting knives has a number of advantages. The guides horns 126, in addition to opening the nosepieces 122 to miss the cathode plate, also centre the cathode plate between the knives in case it is misaligned. The closed entry knives need no surface to land on because of the effective guidance provided by the guide horns 126, and if wings should be present on the deposits, the wings tend to assist in the entry of the knives into the cathode plate-deposit interface.

The speed at which the initial parting knives can approach the cathode plate can be high, thus giving a short cycle time. This is much shorter than the time required for the subsequent stripping at the main stripping station C. The initial parting station B can, therefore, also incorporate the guard piece removal mechanism 102 without incurring any loss in cycle time.

Figure 8:
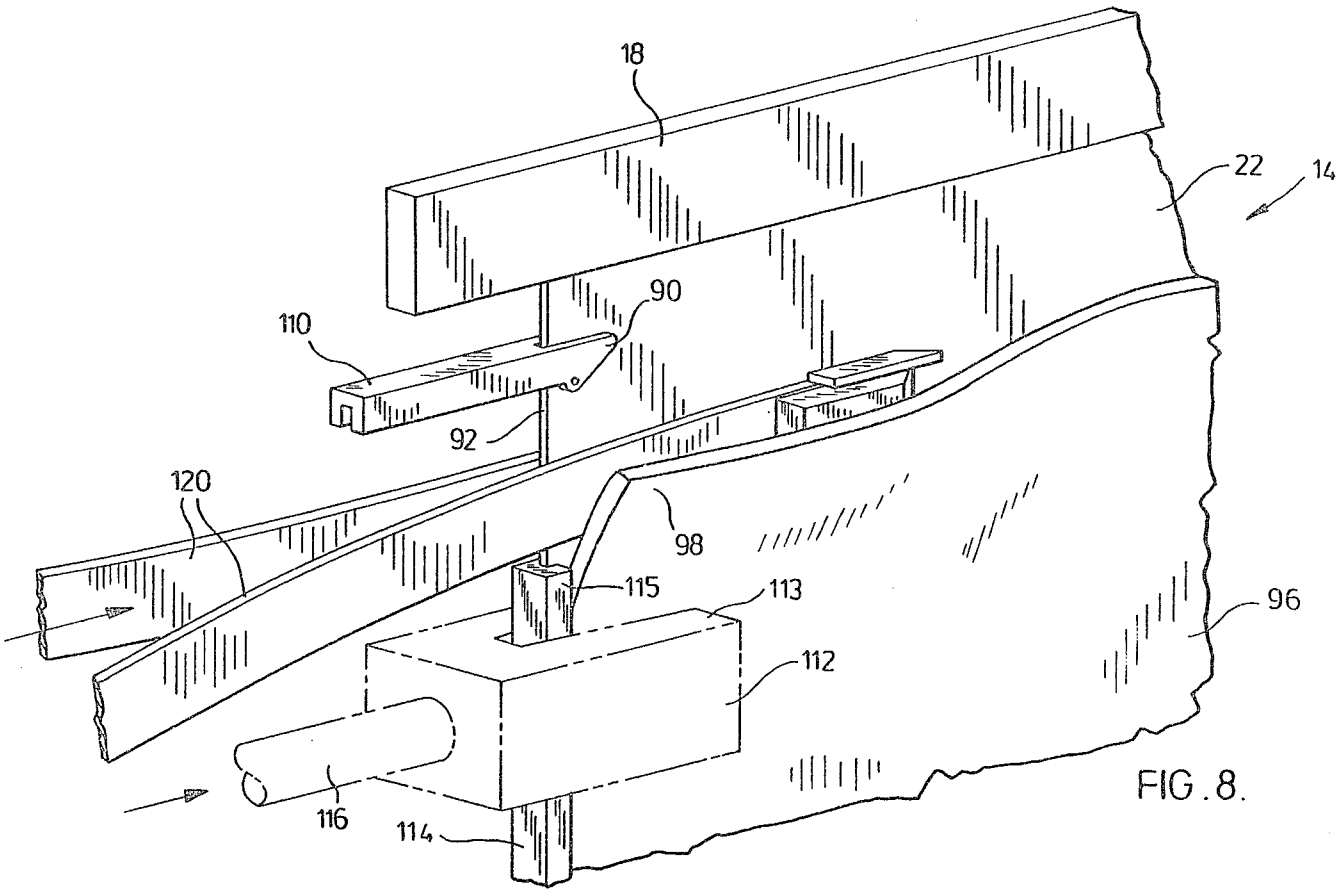
FIG. 8 illustrates the bending of initially parted deposit shown in FIG. 7.
Figure 10:
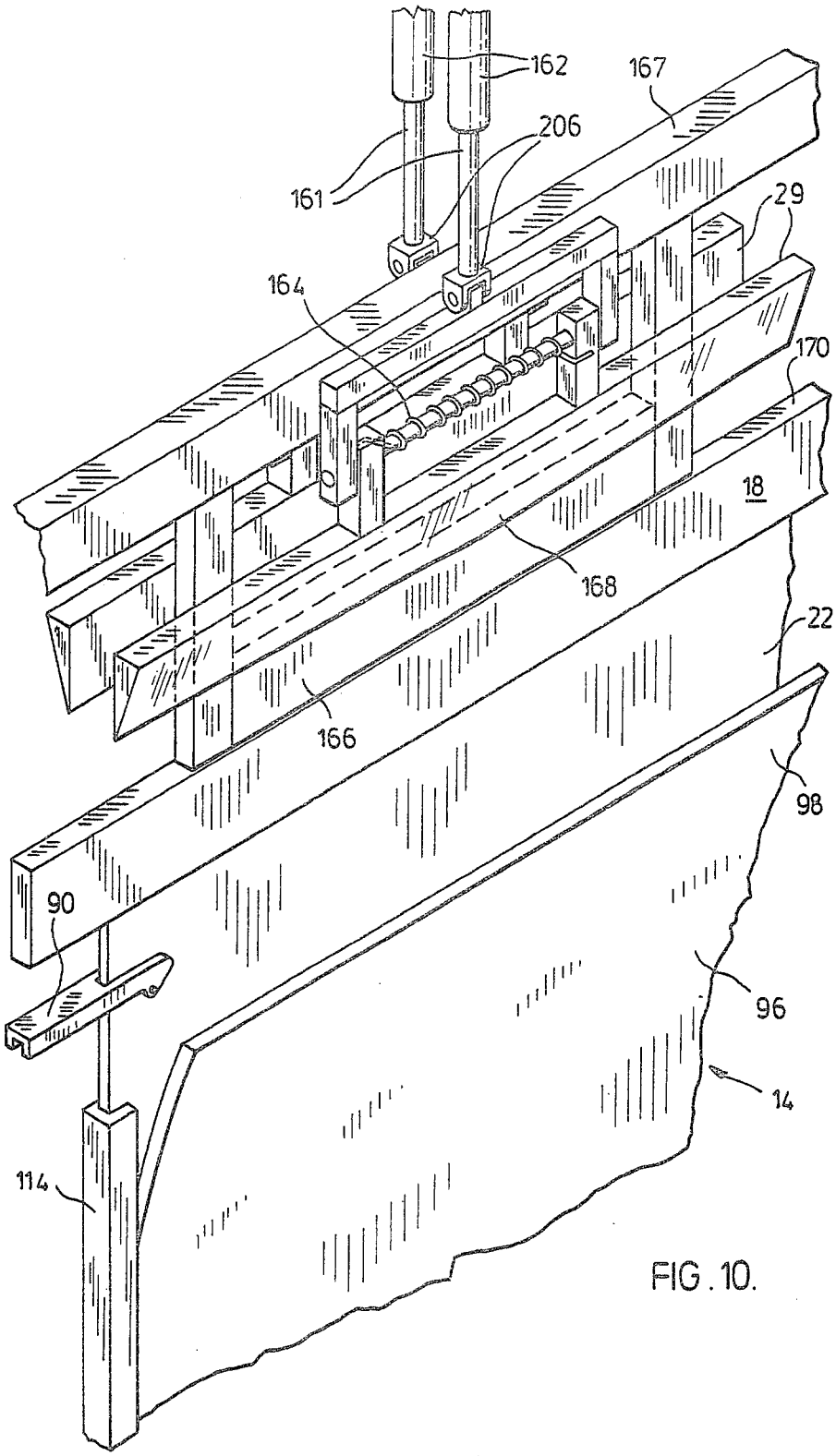
FIG. 10 is a perspective view of the main stripping knives.

The initial parting knives 94 bend the top portions 98 of deposits 96 away from the cathode plate 14 (FIG. 8). This speeds up the subsequent operation of the stripping with the vertical main stripping knives at the main stripping station C. If this were not done, considerable time would be wasted in positioning the main stripping knives behind the deposits.

In some operations, the deposits tend to spring back onto the cathode plate faces and it is advantageous in such cases to bend the deposits more positively to ensure a gap between the top portions 98 of deposits 96 and the cathode plate faces 20 and 22. This can be achieved by providing the optional yokes 112 which extend from both sides of frame 36 to engage and envelop a short length of the vertical edge sticks 114 and underlying cathode plate edges. The yokes 112 are each carried by piston 116 (both shown in ghost lines) and operated hydraulically by a cylinder (not shown). Yokes 112 are positioned at the top portion of the cathode plate 14 below the initial parting knives 94 when the knives have moved onto the cathode plate 14. The yokes 112 serve as stops or fulcrums over which the deposits 96 are bent. The width or spacing of the yoke extensions 113 is selected so that the initial parting knives 94 bend the deposits 96 slightly over the extensions 113, as shown in FIG. 8. This ensures there is a gap between the top portion 98 of the deposits 96 and the cathode plate faces after the initial parting knives 94 and the yokes 112 have been withdrawn.

THE MAIN STRIPPING STATION C

With reference now to FIGS. 4, 5 and 10–12, after the closed entry knives have initially parted the deposits 96 and outwardly bent the top portion 98 of the deposits 96, the cathode plate is moved to the main stripping station C where the vertical main stripping knives 29 are lowered to enter in between the bent deposits 96 and the cathode plate faces 20,22 to complete the separation and removal of the deposits.

In order to achieve complete stripping, the knives 29 must travel vertically down the full length of the cathode plate 14 and return upwards before the next cathode plate can be brought into the main stripping station C. On large cathode plates, the distance travelled by the knives 29 can be in the order of five meters which requires a travel time in the order of six seconds. This exceeds the times required in any of the other stations so that any delays which prevent the vertical knives from descending or retracting will add to the cycle time and decrease productivity.

As soon as the cathode plate has been transferred from the initial parting station B to the main stripping station C, the vertical knives 29 immediately descend to complete stripping of the deposits and then retract. The knives are accelerated as fast as possible to full speed, then retracted as fast as possible as soon as the stripping stroke is completed. In order to accomplish this consistently, the cathode plate must be accurately positioned, no swinging of the cathode plate must occur when the vertical knives come down over the head bar of the cathode plate, the edge sticks must be retained on the cathode plate, and the released deposits must not interfere with the stripping operation.

Accurately positioning of the cathode plate is effected by the transfer mechanism, as has been described above and, in order to prevent swaying of the cathode plate. Tne bottom detents **62*b* as shown in FIG. 1 are introduced at each side of the bottom of the cathode plate to maintain the cathode plate out of vertical plumb, as described above. The bottom detents 62*b* thus in cooperation with the top detents 48*b* hold the cathode plate 14 slightly off the vertical with the bottom of the cathode plate 14** slightly closer to the initial parting station B than the cathode plate head bar.

With the cathode plate accurately positioned and stationary, the vertical, main stripping knives 29 are brought down. The knives 29 are hingeably connected via knuckle joints 206 for vertical movement by rods 161 to cylinders 162, FIGS. 4 and 10. Knives 29 are biased together under constant spring pressure by torque springs 164 for closing on cam 166 which is located just above the head bar 18. The springs 164 and cam 166 are of known design. Cam 166 is fixed to the frame 36 of the stripping machine by support bar 167 and does not interfere in any way with the transfer of cathode plates. The cam 166 keeps the knives 29 open and separated until the leading edges 168 of the knives 29 pass below the top 170 of the head bar 18. The knives 29 then immediately close in on the opposite cathode plate faces 20, 22. Because there is a bare and unobstructed portion of the cathode plate between the bottom of the head bar and the top portion 98 of the bent-away deposits 96 as a result of the initial parting and bending, the vertical knives 29 are assured entry between the deposits 96 and the cathode plate faces 20,22 without in any way having to stop or slow down, or require the use of auxiliary equipment.

Figure 11:
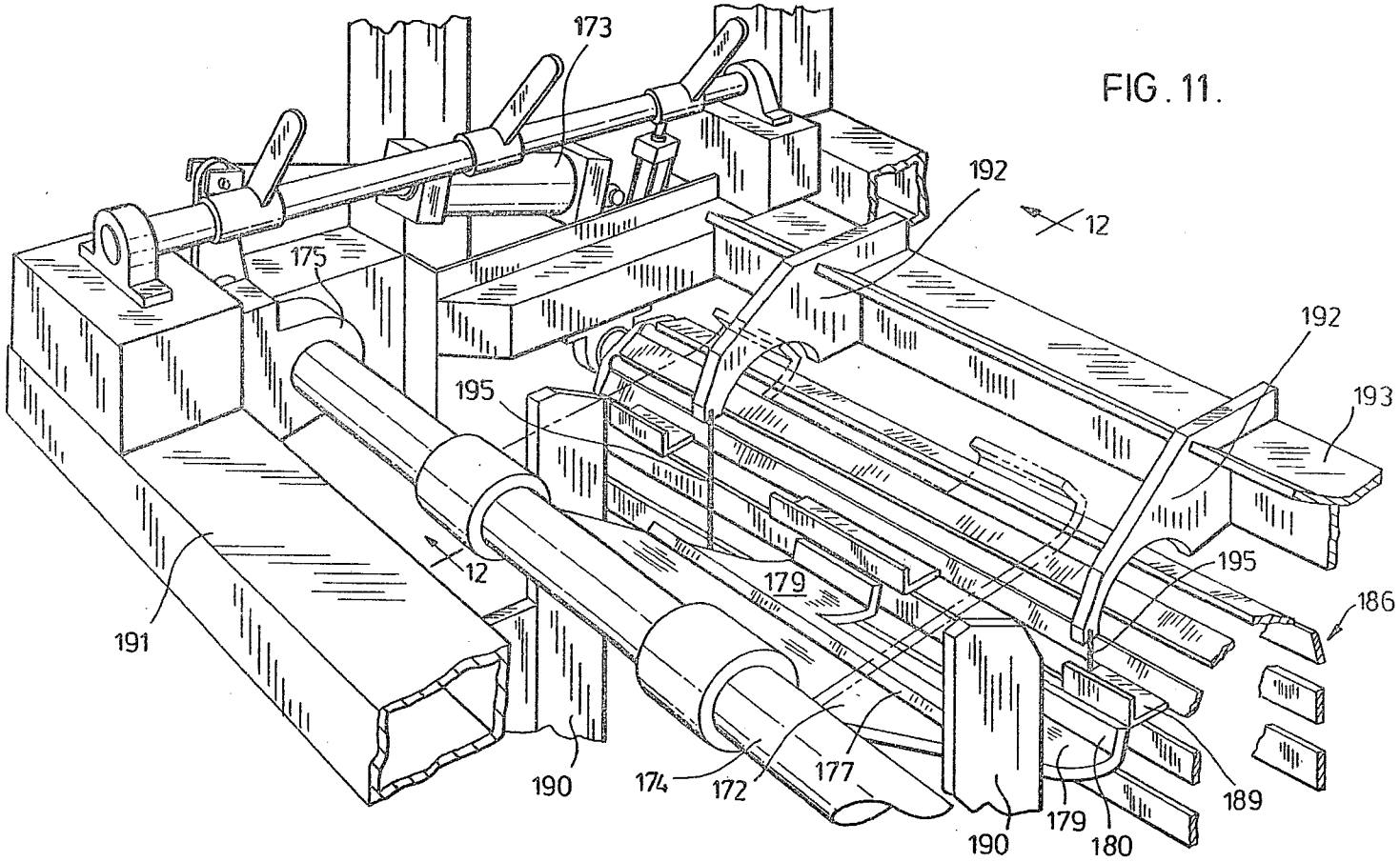
FIG. 11 is a perspective view of the bottom discharge assembly of the main stripping station.
Figure 12:
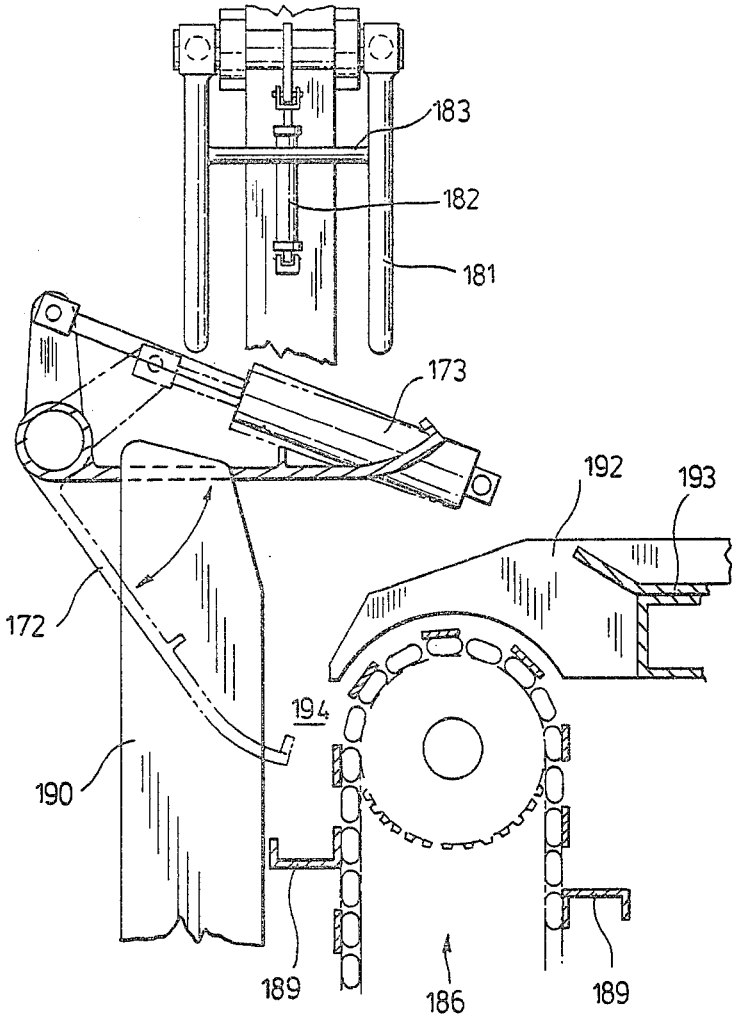
FIG. 12 is a vertical section taken along the line 12—12 of FIG. 11.

While the deposits 96 are being parted from the cathode plate faces 20,22, they are supported by a support plate 172 (FIG. 1). Support plate 172 is pivotally and fixedly positioned on shaft 174 mounted in journals 175, one on each side of frame 36, from a normal at-rest position as shown in FIG. 11, to an upper position as shown in FIGS. 1 and 12. Support plate 172 consists of a flat-plate section 176 having a transverse ridge 177 and a contiguous, slightly curved extension 178 having two spaced-apart, up-curved extensions 179 each with an upstanding terminal edge 180. The up-curved extensions 179 are spaced apart so as to clear the brackets (to be described) on a lowering conveyor 186 when plate 172 is pivoted to its lower position.

Because support of the deposits is not necessary until the end of the stripping stroke by the main knives 29, the support plate 172 swings up under actuation of a piston-cylinder assembly 173 for ridge 177 and upstanding edges 180 to straddle a cathode plate after knives 29 have commenced their downward travel, thereby avoiding delays. The deposits are retained on the plate between ridge 177 and upstanding edges 180 which prevent the separated deposits from moving back and forth on the support plate 172.

As the vertical knives 29 push downwardly between the deposits 96 and the cathode plate 14, the deposits 96 are forced outwardly from the cathode plate. To avoid interference with adjacent parts of the stripping machine, guide forks 181, which are situated about midway of the cathode plate and pivotally mounted, one on each side of frame 36, for actuation by piston-cylinder assembly 182, swing in on each side of the cathode plate as soon as the vertical knives start descending to laterally support the deposits 96. A cross bar 183 between the prongs of forks 181, together with the positive placement of the deposits on support plate 172, prevents any sideways movement of the deposits which may have been caused by uneven loosening of the deposits from the cathode plate due to the occasional tendency for deposits to adhere more in certain areas of the cathode plate than in others. The guide forks 181 also prevent overstressing the knife blades 29, torque springs 164 and driving cylinders 161, 162. The deposits on each side of the cathode plate are in fact one deposit plate joined at the bottom. Without the guide forks, the deposits would bow outwards as knives 29 approach the bottom of the cathode plate. The knife blades would then slow down and the knuckle joints 206 bow outwards with the deposits. This puts severe stress on the knife blades, torque springs and driving cylinders. With the guide forks in position, the knuckle joints are prevented from swinging outwards and the knives push down to complete the stripping and sometimes even cut through the bottom joint between the two deposits. The guide forks 181 remains in the upward, supporting position until the deposits are being lowered by lowering conveyor 186. An optical sensor, not shown, senses when knives 29 have completed their downward travel and signals cylinders 162 to retract knives 29 to their upper position.

Lowering conveyor 186 comprises a number of transverse plates 187 mounted in parallel, closely spaced-apart relationship on a pair of spaced-apart conveyor chains 188. A plurality of plates 187 has three up-turned angle brackets 189 mounted thereon in spaced-apart relationship such that the curved extensions 179 of curved section 178 of support plate 172 can pass between them. Tne plates 187 which have brackets 189 mounted thereon are distanced apart slightly more than the height of a cathode deposit. Angle brackets 189 are adapted to receive the lower edges of the stripped metal deposits 96 and to lower the deposits from the stripping machine.

To ensure that the deposits are received in angle brackets 189, two curved guides 190 are mounted on cross support bar 191 of frame 36, one on each side of support plate 172 (FIGS. 11 and 12), and two inverted hook-shaped guides 192 are mounted on cross support bar 193 of frame 36 in alignment with curved guides 190 and are curved over lowering conveyor 186. Curved guides 190 and hook-shaped guides 192 are curved down toward each other defining a funnel-shaped gap 194 to guide the deposits onto the brackets 189 of the conveyor. Further guidance is provided by cables 195, one attached to the end of each of hook-shaped guides 192 and extending downwardly over plates 187 between angle brackets 189.

After deposits 96 have been separated from cathode plate 14, support plate 172 pivots downwardly, activated by assembly 173. The curved extensions 179 of plate 172 moved between brackets 189 and the deposits are guided by the pivoting of plate 172 and by guides 190 and 192 into brackets 189. As soon as deposits 96 are placed in brackets 189, the conveyor lowers the deposits from the stripping machine. Plate 172 is pivoted down sufficiently to clear the conveyor 186 and the deposits 96 on the conveyor. While the deposits are being lowered, assembly 182 is activated to lower the guide forks 181 into their down position. When the deposits have been lowered sufficiently, the transfer carriage 26 is activated to return to its starting position and the shafts 46 and 60 are rotated to move the detents 48 and 62 out of the path of the cathode plates. Carriage 26 is then activated to advance a set of cathode plates through the stripping machine, the cathode plate from which the deposits have just been removed being advanced forward to replacement station D.

REPLACEMENT STATION D

Figure 7:
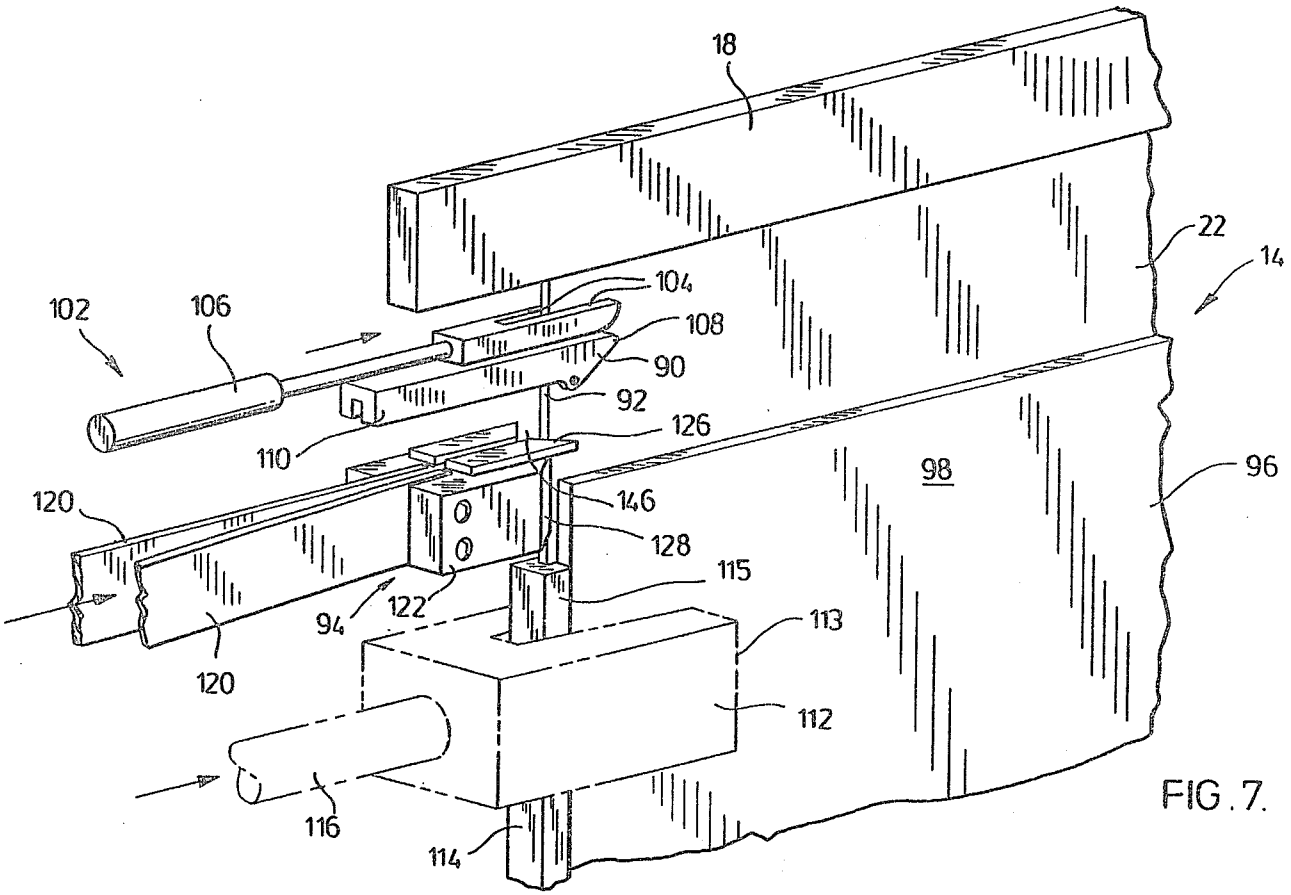
FIG. 7 is a persective view of the operative components at the initial parting stage.

To replace the guard piece 90 onto the cathode plate 14, the guard piece 90 is first rotated from the horizontal position shown in FIG. 7 downwards through about 60 degrees. The rotation is effected by a stationary cam 200 secured to slide bar 28, which engages the upper surface of the guard piece while the cathode plate is moving from the main stripping station C to the replacement station D, to depress the guard piece. A hydraulically-actuated hammer 202 pivotally mounted on the frame 36 at station D then lightly pushes or taps the guard piece at a right angle to the cathode plate edge onto the cathode plate edge and in interlocking engagement with the cathode plate edge stick 114.

PICK-UP STATION E

The stripped cathode plate is pushed from slide bars 28 by the last pair of dogs 42 on transfer carriage 26 onto conveyor 16 for transporting the stripped cathode plate 14 from the stripping machine to a subsequent operation or to the electrolytic cells. The pick-up conveyor 16 may be a monorail conveyor, as shown in FIGS. 2–4, or a chain conveyor similar to feed chain conveyor 30. A detent or stop 204, FIG. 4, mounted on frame 36 steadies cathode plates 14 as they are conveyed from the stripping apparatus.

All the foregoing description is with reference to a preferred embodiment of the invention, but it is to be understood that changes and variants may be introduced which are equivalent from the point of view of the function and structure, without falling thereby outside the scope of the invention. For example, the guard piece could be moved from and replaced on the cathode plate edge by means outside the stripping machine in which case the replacement station would not be necessary within the confines of the stripping machine.

DISCHARGE CHUTE

Removal of deposits 96 from a cathode plate 14 may be effected at the main stripping station C by the embodiment of the invention to be described with reference to FIGS. 13–20. Generally, stripped metal deposits are removed by a discharge chute disposed below the vertical stripping station. The discharge chute comprises a plurality of slide rails, each having an upper, an intermediate and a lower section. Trap means are disposed at the upper section for interrupting the fall of the discharging deposits. Speed regulating means are provided at the lower section for controlling the discharge speed of the deposits from the chute.

Figure 13:
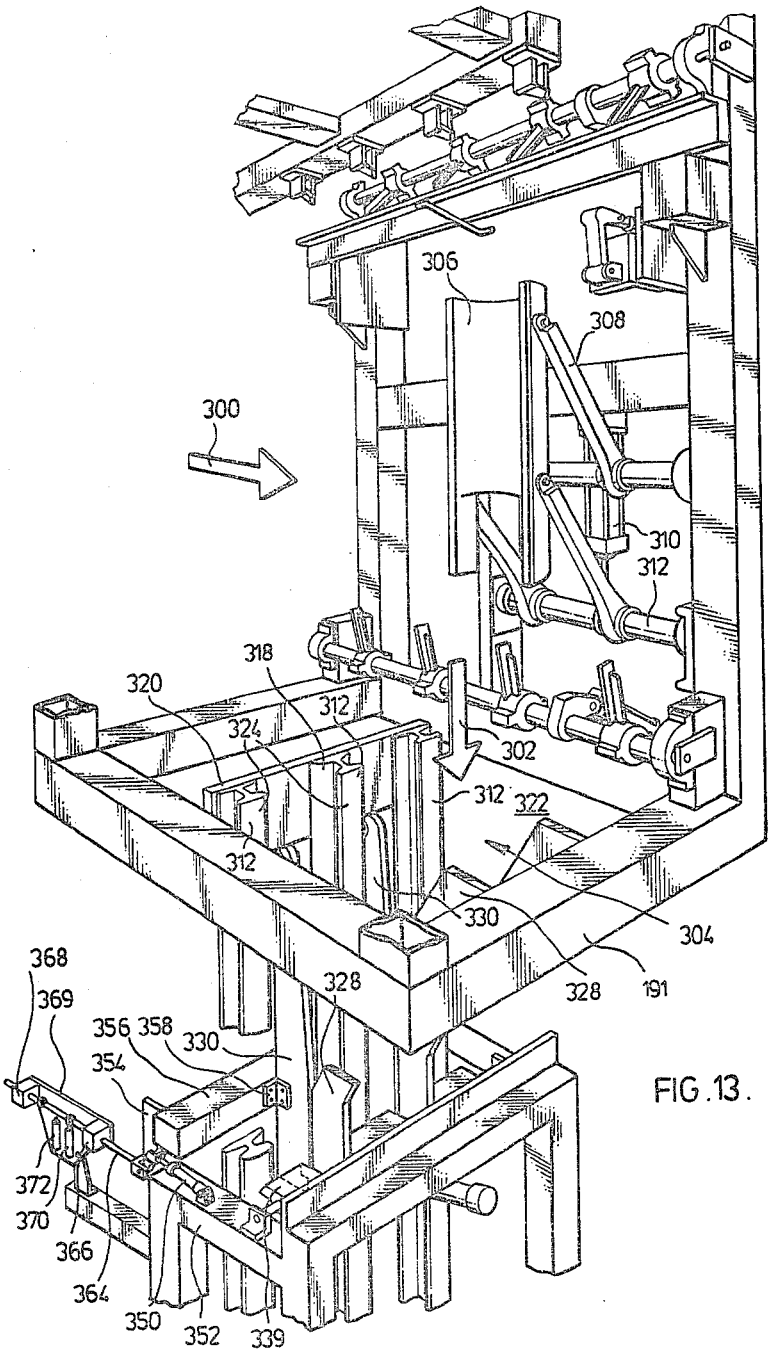
FIG. 13 is a perspective view of a portion of an embodiment of the stripping apparatus illustrating the upper portion of a bottom discharge chute at the main stripping station.

With reference now to FIG. 13, arrow 300 indicates the movement of cathode plates bearing deposits towards the stripping station and arrow 302 indicates the vertically downward movement of stripped deposits into the upper portion of discharge chute 304. Stripped deposits are guided in their downward travel by a pair of opposed elongated U-shaped guides or forks 306, one of which is shown, adapted to be extended as shown during the stripping operation by downward pivotal movement of pivotally-mounted support arms 308 by rotation of shaft 312 by means of piston-cylinder assembly 310.

Chute 304 comprises a plurality of equispaced slide rails 312, preferably three slide rails, having their base flanges 318 secured to a transverse support plate 320. The upper portions of rails 312 are substantially vertically aligned in a common plane extending across the chute opening 322 with the exposed surfaces 324 of the rails disposed to one side of a cathode plate located in the stripping station such that stripped deposits, indicated by numeral 326 in FIG. 14, will fall between rail surfaces 324 and a pair of opposed stationary trap arms 328 affixed to frame member 191. Trap arms 328 are inclined at a small angle of about 5° from the vertical towards rails 312 to guide stripped deposits 326 onto opposed pivotal trap arms 330 which are inclined at a small angle of about 5° away from vertical rails 312.

Figure 18:
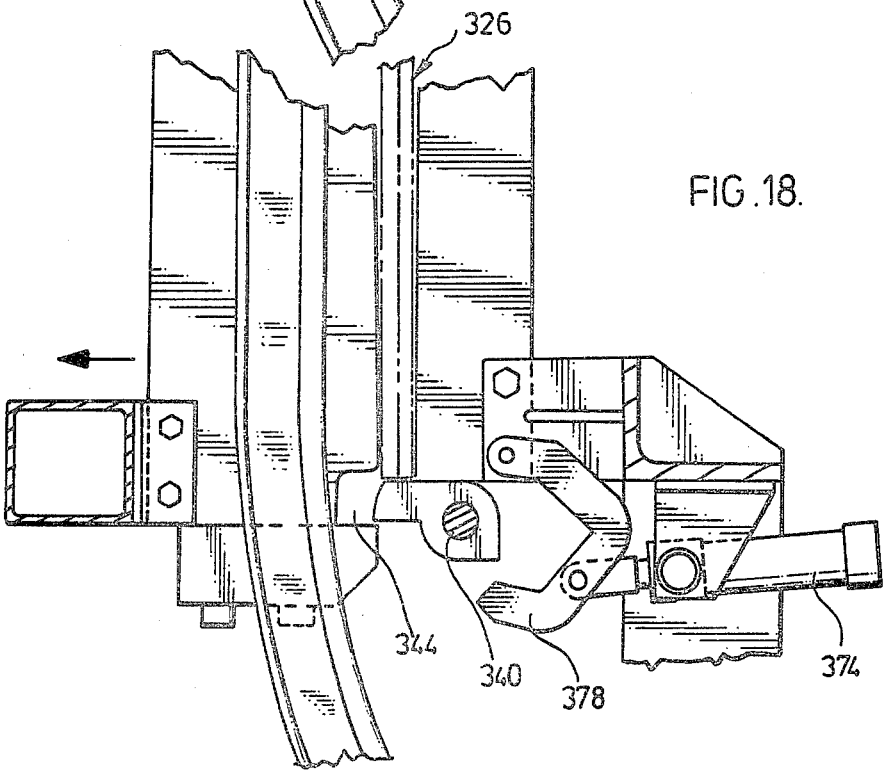

Pivotal trap arms 330 are pivoted at their upper ends at 332 and define with stationary trap arms 328 a wedge-shaped trap depicted by numeral 334 for temporarily capturing deposits 326 at trap mechanism 336 located at the bottom of vertical rail section 338. Trap mechanism 336, shown most clearly in FIGS. 14 and 17–20, includes in addition to stationary trap arms 328 and pivotal trap arms 330 a transverse trap or detent plate 339 pivoted at 340 at the base of stationary trap arms 328 to extend across the width of the chute. The free end 342 of plate 339 is adapted to seat in notches 344 formed in the lower ends of pivotal trap arms 330 whereby deposits descending into the trap are stopped at plate 339, as shown in FIG. 18, to break their fall.

Figure 14:
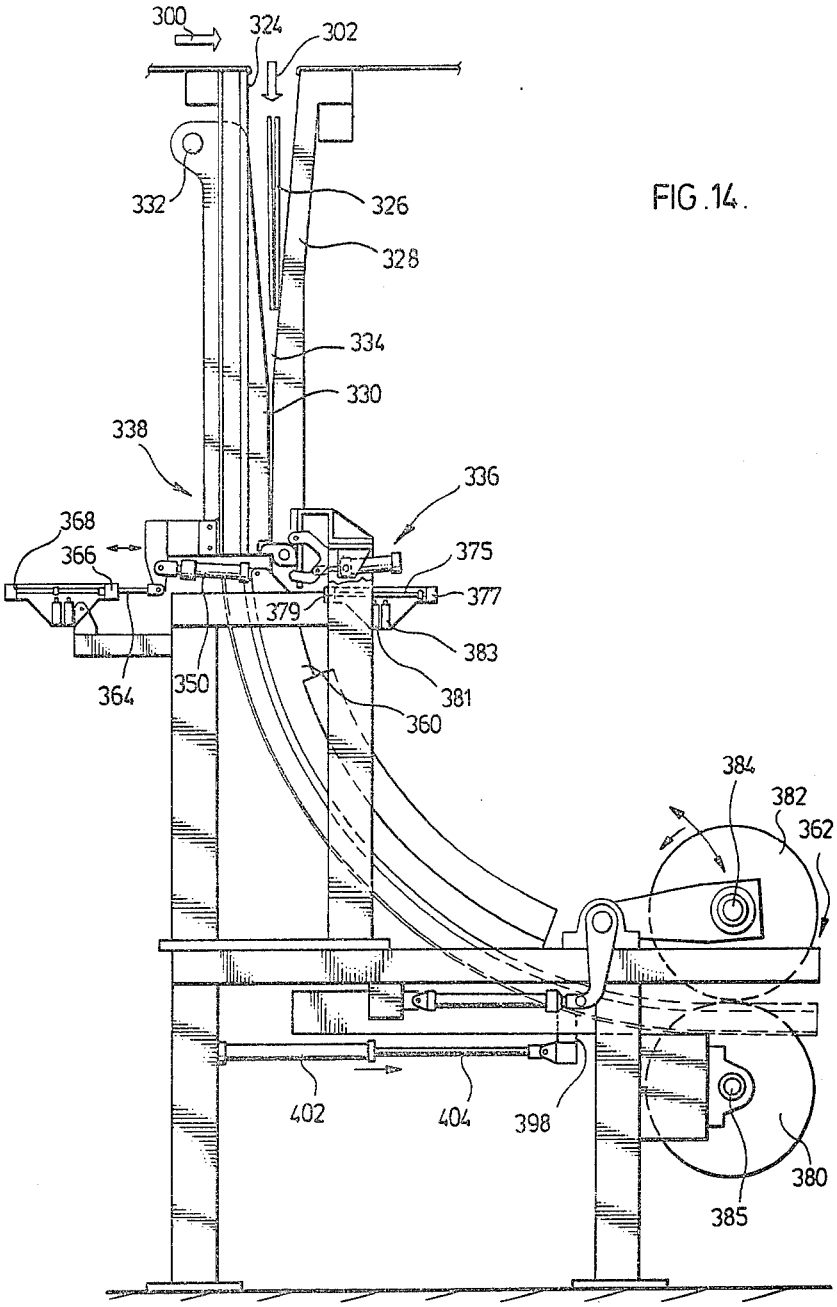
FIG. 14 is a side elevation of the bottom discharge chute.
Figure 19:
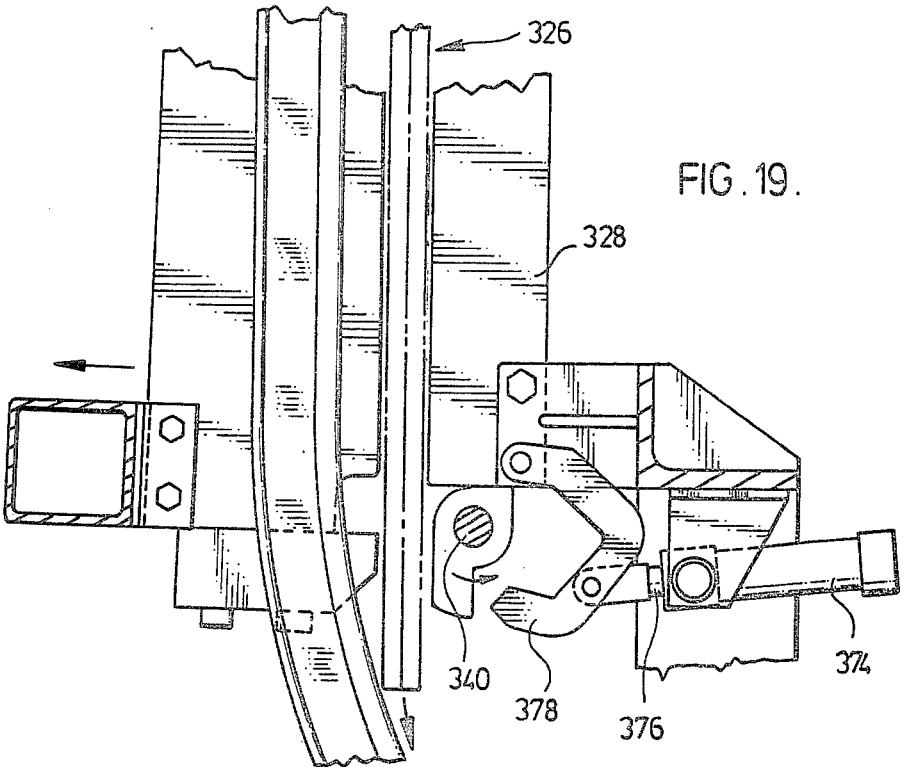

Double-acting hydraulic piston-cylinder assembly 350, shown most clearly in FIGS. 13 and 14, is pivotally mounted at one end on frame 352 and at the other end on bracket 354 extending from transverse arm 356 secured to pivotal trap arms 330 by connectors 358, to move the trap arms 330 away from stationary trap arms 328 releasing detent plate 339 from notches 344 and permitting said plate to pivot downwardly, FIG. 19, to release deposits supported thereby. Deposits 326 continue their descent down the intermediate curved section 360 of the rails through about 90° to the horizontal discharge rail section 362 with speed regulating means, to be described.

Figure 20:
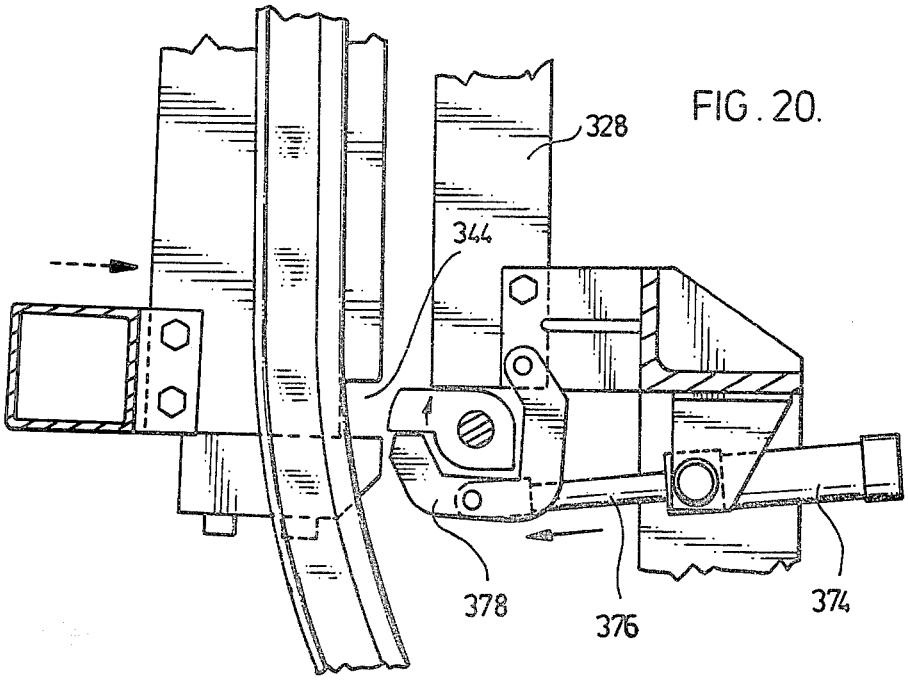

Push rod 364, pivotally mounted at one end on bracket 354 and extending through guide sleeves 366, 368 on stationary support 369, is adapted to actuate limit switches 370, 372 operatively connected to piston-cylinder assembly 350 to stop the outward travel of pivotal trap arms 330 and to reverse assembly 350 for return of said pivotal trap arms to the position shown in FIG. 20. Concurrent with retraction of assembly 350, double-acting piston-cylinder assembly 374 is activated by push rod 375 to extend piston 376 and move C-shaped actuator 378 pivotally mounted on at the base of arms 328 in a clockwise direction as viewed in FIG. 20 to reposition detent plate 339 to its normal at-rest horizontal position in notches 344. Push rod 375, slidably mounted for linear reciprocal travel in guide sleeves 377, 379, interacts with limit switches 381, 383 to stop the extension of piston rod 376 and to reverse assembly 374 for return of actuator 378 to its normally at-rest position shown in FIGS. 17, 18.

Figure 15:
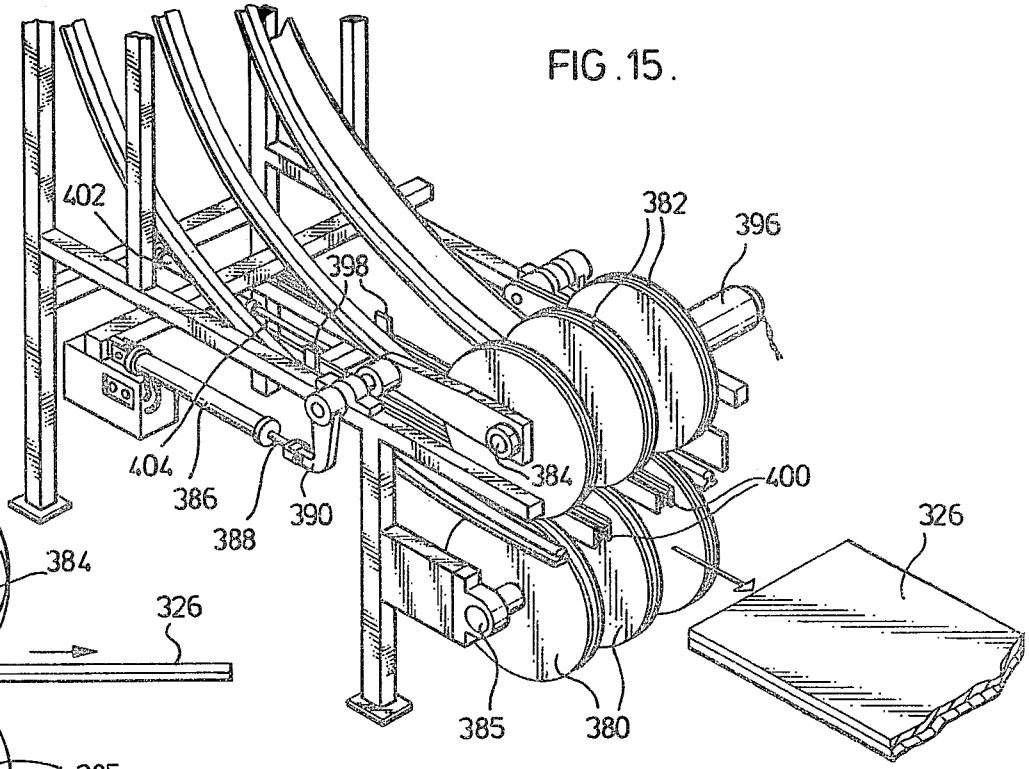
FIG. 15 is a perspective view of the lower portion of the bottom discharge chute.
Figure 16:
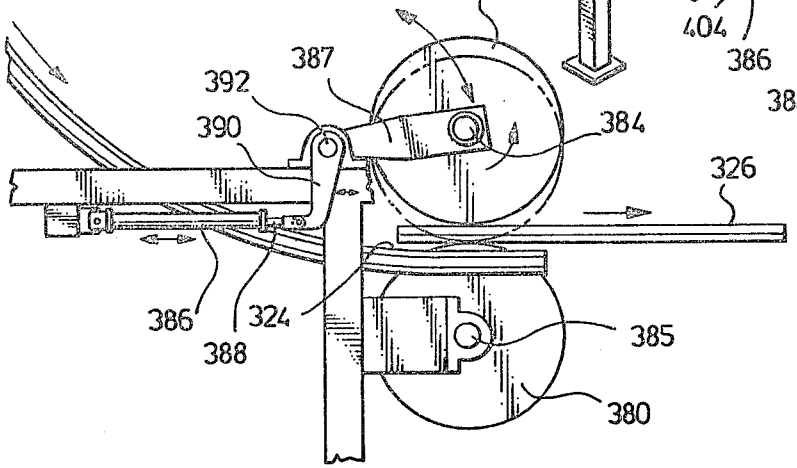
FIG. 16 is a side elevation of the apparatus shown in FIG. 15 illustrating the operation of the discharge mechanism.
Figure 17:
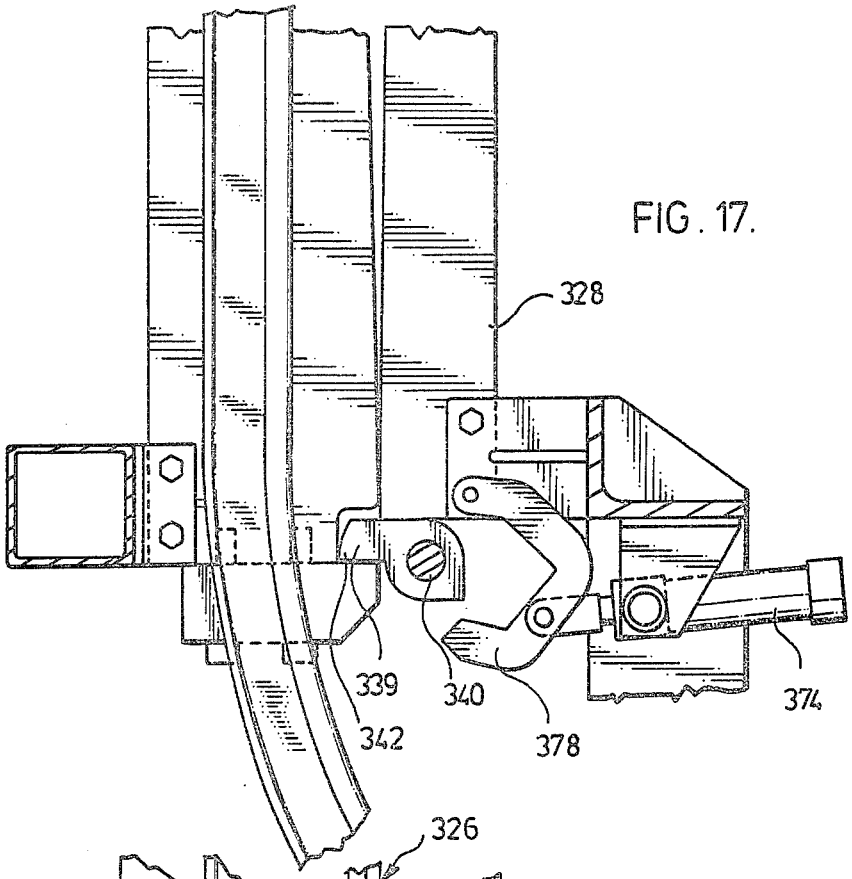
FIGS. 17–20 are detailed side elevations of the trap mechanism at the base of the vertical portion of the discharge chute illustrating the operation of the said trap mechanism.

A plurality of equispaced lower wheels 380 journalled on a common axle 385, preferably a wheel 380 adjacent each rail 312, FIGS. 14–16, extend slightly above the bearing surfaces 324 of rails 312 to frictionally engage the underside of deposits 326 as they pass between lower wheels 380 and pivotally-mounted plurality of opposed upper wheels 382 journalled on common axle 384 carried by spaced-apart pivot arms 387, one of which is keyed on shaft 392. Upper wheels 382 pivot substantially vertically upwardly, FIG. 16, sufficiently to allow deposits 326 to pass through to a stacker, not shown, under the downward bias of hydraulic spring 386. Hydraulic spring 386 has piston rod 388 connected to crank 390 which in turn is keyed to shaft 392 for maintaining a downward, or clockwise bias as viewed in FIGS. 15 or 16, on axle 384 and wheels 382.

Either one or both axles 384 and 385 has a hydraulic or electric drive motor 396 operatively connected thereto to accelerate or decelerate, as necessary, the discharge speed of the deposits between the opposed sets of wheels to the peripheral velocity of the wheels for a desired exit velocity.

A pusher mechanism, shown most clearly in FIGS. 14 and 15, comprises an upstanding pusher plate 398 adapted for horizontal sliding travel in each of spaced-apart guide tracks 400 from the retracted position illustrated to an extended position, not shown, by means of double-acting hydraulic piston-cylinder assembly 402, FIG. 15, having piston rod 404, to engage the deposits and to positively assist the travel and discharge of deposits 326 between the opposed sets of wheels 380, 382.

It will be understood that modifications can be made in the embodiment of the invention illustrated and described herein without departing from the scope and purview of the invention as defined by the appended claims.

What we claim as new and desire to protect by Letters Patent of the United States is:

1. A method for stripping electro-deposited sheets of metal from cathode plates used in the electrolytic recovery of metals, each cathode plate having a head bar at one end for vertical support of the cathode plate, opposite side faces with metal deposits thereon, and vertical side edges having edge sticks mounted thereon and a pivotal guard piece forming a separate upper portion of one of said edge sticks, said method comprising: advancing said cathode plates crosswise to the direction of travel sequentially through a plurality of equispaced stations in succession by means of a reciprocating transfer carriage, said plurality of stations consisting of a feed station, an initial horizontal parting station, a main vertical stripping station, and a discharge station; said transfer carriage mounted for horizontal reciprocal travel above a pair of parallel, spaced-apart slide bars over a distance equal to the distance between a pair of adjacent stations, said transfer carriage having means formed thereon for engaging a cathode plate head bar at each station for advance of the cathode plates on the slide bars to a successive station; actuating detent means operable into and out of engagement with the opposite side edges of the cathode plates at the initial horizontal parting station and vertical stripping station for positioning the cathode plates and preventing sway of said cathode plates at each of the said stations; pivoting said guard piece upwardly away from the side edge of the cathode plate; initially parting the top edge of the metal deposit on each side face of the cathode plate from the cathode plate and bending the said top edges outwardly away from the cathode plate to form a gap between the top edges and the face of the cathode plate at the initial horizontal parting station; vertically reciprocating main stripping knives which engage the deposited metal at the gap on each side face of the cathode plate and strip metal deposits downwardly from each side face of the cathode plate for removal of the said metal deposits therefrom at the vertical stripping station; and removing stripped cathode plates at the discharge station.

2. A method as claimed in claim 1 in which said plurality of stations includes a replacement station after the main vertical stripping station whereby cathode plates are advanced to the replacement station after the said vertical stripping station and detent means are actuated into engagement with the opposite side edges of the cathode plates for pivoting the guard piece onto the vertical side edge to form the separate upper portion of the one edge stick.

3. A method as claimed in claim 2 in which the top edge of the metal deposit on each side face of the cathode plate is initially parted from the cathode plate and bent outwardly by horizontally extending a pair of initial parting knives, one on each side of the cathode plate between the deposit and the cathode plate.

4. A method as claimed in claim 3 in which a yoke is extended to engage and envelop a short length of edge stick and underlying cathode plate edges at each side edge of the cathode plate at the top portion of the cathode plate below the initial parting knives to restrain the deposits and serve as fulcrums over which the deposits are bent.

5. A method as claimed in claim 1 in which removal of said metal deposits at the vertical stripping station comprises discharging the metal deposits downwardly into a curved discharge chute having a vertical upper section, a horizontal lower section and an intermediate curved section for guiding the metal deposits to a horizontal discharge, temporarily interrupting the fall of the metal deposits at the vertical upper section, and regulating the speed of discharge of the metal deposits from the chute.

6. An apparatus for stripping electro-deposited sheets of metal from cathode plates used in the electrolytic recovery of metals, each cathode plate having a head bar at one end for vertical support of the cathode plate, opposite side faces with metal deposits thereon, vertical side edges having edge sticks mounted thereon and a pivotal guard piece forming a separate upper portion of one of said edge sticks and a bottom edge, said apparatus comprising: a frame having a plurality of equispaced stations therein; means for advancing said cathode plates crosswise to the direction of travel sequentially through the plurality of equispaced stations in succession, said plurality of stations consisting of a feed station, an initial horizontal parting station, a main vertical stripping station, and a discharge station; said advancing means comprising a pair of parallel spaced-apart slide bars for supporting the head bars of cathode plates; a transfer carriage mounted for horizontal reciprocal travel on said slide bars over a distance equal to the distance between a pair of adjacent stations, said transfer carriage having means formed thereon for engaging a cathode plate head bar at each station for advance of the cathode plates on the slide bars to a successive station, said advance extending substantially the distance between two adjacent stations during reciprocal travel of said carriage; detent means operable into and out of engagement with the opposite side edges of the cathode plates at each of said horizontal parting and vertical stripping stations for positioning the cathode plates and preventing sway of said cathode plates at each of the stations; means for pivoting said guard piece upwardly away from the side edge of the cathode plate; means horizontally reciprocal adapted to extend across said cathode plate for initially parting the top edge of the metal deposit on each side face of the cathode plate from the cathode plate and for bending the top edges outwardly away from the cathode plate to form a gap between the top edges and the faces of the cathode plate; means at the main vertical stripping station vertically reciprocal for engaging the deposited metal at the gap on each side face of the cathode plate and for stripping metal deposits downwardly from each side face of the cathode plate for removal therefrom; and conveyor means for removing stripped cathode plates at the discharge station.

7. An apparatus as claimed in claim 6 in which a replacement station is provided intermediate and equidistant the vertical stripping station and the discharge station for pivoting the guard piece onto the vertical side edge to form the upper portion of the one edge stick and detent means are provided to position the cathode plate and prevent sway thereof at the replacement station.

8. An apparatus as claimed in claim 7 in which said transfer carriage has rollers provided thereon adapted to co-act with carriage rails secured to said frame, piston-cylinder means for advancing and retracting the carriage in guided horizontal travel on said rails, and a pair of laterally-spaced, pivotally-mounted dogs depending downwardly from the carriage corresponding to each of the stations for engaging the header bars of cathode plates at each of the stations and advancing the cathode plates to the next successive station during advance of the carriage.

9. An apparatus as claimed in claim 8 in which shock-absorbing means are provided between the transfer carriage and the frame for decelerating the carriage at the end of travel during advance of the carriage.

10. An apparatus as claimed in claim 6 in which said detent means comprise laterally-spaced pairs of upper and lower detents located at the stations adapted to be pivoted into and out of the path of travel of the cathode plates whereby the cathode plates are accurately positioned at a station by abutment with a pair of detents, the lower detents being out of plumb with the corresponding upper detents in the direction of the feed station whereby each of the cathode plates abutting the detents are supported out of the vertical and held against the detents by gravity.

11. An apparatus as claimed in claim 6 in which said horizontally reciprocal means adapted to extend across said cathode plate for initially parting the top edge of the metal deposit on each side face of the cathode plate from the cathode plate and for bending the top edges outwardly away from the cathode plate to form a gap between the top edges and the faces of the cathode plate include a pair of initial parting knives adapted to be extended and retracted horizontally at the initial horizontal parting station, one knife on each side of the cathode plate between the deposit and the cathode plate.

12. An apparatus as claimed in claim 11 in which a yoke is reciprocally mounted to engage and envelop a short length of edge stick and underlying cathode plate edges at each side edge of the cathode plate at the top portion of the cathode plate below the initial parting knives to restrain the deposits and serve as fulcrums over which the deposits are bent.

13. An apparatus as claimed in claim 11 in which the pair of initial parting knives comprises two interdependent opposed components each composed of a leaf spring attached to a common crosshead support, a nosepiece having a sharp leading edge adapted to penetrate between the deposit and adjacent cathode plate face mounted at the leading edge of the leaf spring, rollers journalled in the nosepiece for rolling engagement with the cathode plate surface, and a guide horn having an outwardly bevelled leading edge mounted on the nosepiece above the level of the metal deposit upper edges whereby adjacent guide horns define a V-shaped opening adapted to ride on the cathode plate faces for alignment of the nosepieces with the cathode plate and the leading edge of each nosepiece can enter between the deposit and the adjacent cathode plate face.

14. An apparatus as claimed in claim 6 in which the means at the main vertical stripping station vertically reciprocal for engaging the deposited metal at the gap on each side face of the cathode plate and for stripping metal deposits downwardly from each side face of the cathode plate for removal therefrom comprises main stripping knives normally retracted above the main stripping station and adapted to travel vertically down the full length of the cathode plates, the knives comprising opposed, laterally-disposed blades normally biased towards each other, and cam means interposed between the said knife blades for spacing the knife blades apart for unobstructed vertical travel over the cathode plate head bar.

15. An apparatus as claimed in claim 14 in which a pair of opposed guide forks is mounted within the frame at the main vertical stripping station, one on each side of the frame, adapted to engage a cathode plate positioned at the said stripping station about mid-way of the cathode plate, said forks preventing sideways movement of deposits as they are loosened from the cathode plate.

16. An apparatus as claimed in claim 15 in which the stripped metal deposits are removed by a lowering conveyor disposed below the vertical stripping station and a support plate pivotally mounted below tne vertical stripping station for receiving and supporting the stripped deposits, said plate having a pair of spaced-apart, up-curved extensions extending from the free end thereof and a lateral ridge equi-spaced from the said up-curved extensions whereby the cathode plate and deposits straddle said support plate between the ridge and up-curved extensions.

17. An apparatus as claimed in claim 16 in which said lowering conveyor has a plurality of transverse plates, a number of said plates being equispaced apart a distance slightly greater than the height of the cathode deposits and having a central up-turned bracket, and a pair of outer up-turned brackets spaced therefrom adapted to permit the up-curved extensions of the support plate to pass therebetween, and a deflector rigidly mounted on each side of the support plate adapted to deflect stripped deposits onto the upturned brackets of the lowering conveyor.

18. An apparatus as claimed in claim 17 in which a pair of opposing deflectors is mounted at each side of the support plate for guiding stripped deposits onto the conveyor.

19. An apparatus as claimed in claim 17 in which said opposed guide forks at the vertical stripping station each has a cross-bar between prongs of the fork adapted to engage the side edges of the cathode plate for co-operation with the support plate for preventing sideways movement of the deposit stripped from the cathode plate.

20. An apparatus as claimed in claim 15 in which the stripped metal deposits are removed by a discharge chute disposed below the vertical stripping station, said discharge chute comprising: a plurality of equispaced slide rails each having a vertical upper section and a horizontal lower section with an intermediate curved section for receiving stripped metal deposits discharged downwardly from the vertical stripping station and guiding said deposits to a horizontal discharge, trap means disposed at the vertical upper section of the slide rails for interrupting the fall of discharging deposits, and speed regulating means at the horizontal lower section of the slide rails for controlling the speed of discharge of said deposits from the chute.

21. An apparatus as claimed in claim 20 in which the trap means include a transverse detent plate pivotally mounted at the lower end of the vertical upper section of the guide rails for pivotal travel from a normally at-rest horizontal position to a downward position, means releasably locking said detent plate in the horizontal position, and means for pivoting said detent plate from the downward position to the horizontal position.

22. An apparatus as claimed in claim 21 in which the trap means additionally include at the vertical upper section at least one stationary trap arm having the detent plate pivotally mounted at the lower end thereof, at least one opposed pivotal trap arm having a notch formed thereon for receiving the detent plate, said trap arms together defining a downwardly inclined wedge-shaped trap, and means for pivoting the pivotal trap arm away from and towards the stationary trap arm, whereby said detent plate is releasably locked on said pivotal trap arm.

23. An apparatus as claimed in claim 22 in which said means for pivoting the pivotal trap arm includes a piston-cylinder assembly.

24. An apparatus as claimed in claim 22 in which the speed regulating means at the lower horizontal section of the slide rails includes a plurality of lower wheels rotatably mounted in a stationary position transverse of the slide rails, a plurality of opposed upper wheels pivotally mounted for substantially vertical travel above the lower plurality of wheels towards and away from the said lower wheels, means for driving at least one plurality of said wheels at a desired peripheral speed, and means for biasing said upper plurality of wheels against the lower plurality of wheels to frictionally engage stripped metal deposits therebetween whereby said metal deposits are discharged from the chute at a predetermined discharge speed.

25. An apparatus as claimed in claim 22 in which the speed regulating means at the lower horizontal section of the slide rails includes a plurality of lower wheels rotatably mounted in a stationary position transverse of the slide rails, a plurality of opposed upper wheels pivotally mounted for substantially vertical travel above the lower plurality of wheels towards and away from the said lower wheels, means for driving at least one plurality of said wheels at a desired peripheral speed, means for biasing said upper plurality of wheels against the lower plurality of wheels to frictionally engage stripped metal deposits therebetween whereby said metal deposits are discharged from the chute at a predetermined discharge speed, and a pusher mechanism for engaging the deposits to positively assist the travel and discharge of the deposits.

26. An apparatus as claimed in claim 25 in which said upper wheels are pivotally mounted for substantially vertical travel on an axle, said axle supported at each end on pivot arms, and said means for biasing said upper plurality of wheels against the lower plurality of wheels comprises a shaft on which one of said pivot arms is mounted, a crank connected to said shaft for rotating said shaft and pivoting said pivot arm, and a hydraulic spring operatively connected to the crank for maintaining a bias on the crank for transmittal of the bias to the upper plurality of wheels.

27. A chute for controllably discharging metal sheets comprising: a plurality of equispaced slide rails each having a vertical upper section and a horizontal lower section with an intermediate curved section for receiving metal sheets discharged downwardly thereinto from above and guiding said sheets to a horizontal discharge, trap means disposed at the vertical upper section of the slide rails for interrupting the fall of discharging sheets, and speed regulating means at the horizontal lower section of the slide rails for controlling the speed of discharge of said sheets from the chute, said trap means including a transverse detent plate pivotally mounted at the lower end of the vertical upper section of the guide rails for pivotal travel from a normally at-rest horizontal position to a downward position, means releasably locking said detent plate in the horizontal position, and means for pivoting said detent plate from the downward position to the horizontal position.

28. An apparatus as claimed in claim 27 in which the trap means additionally include at the vertical upper section at least one stationary trap arm having the detent plate pivotally mounted at the lower end thereof, at least one opposed pivotal trap arm having a notch formed thereon for receiving the detent plate, said trap arms together defining a downwardly inclined wedge-shaped trap, and means for pivoting the pivotal trap arm away from and towards the stationary trap arm, whereby said detent plate is releasably locked on said pivotal trap arm.

29. An apparatus as claimed in claim 27 in which said means for pivoting the pivotal trap arm includes a piston-cylinder assembly.

30. An apparatus as claimed in claim 28 in which the speed regulating means at the lower horizontal section of the slide rails includes a plurality of lower wheels rotatably mounted in a stationary position transverse of the slide rails, a plurality of opposed upper wheels a pivotally mounted for plurality of opposed upper wheels pivotally mounted for substantially vertical travel above the lower plurality of wheels towards and away from the said lower wheels, means for wheels towards and away from the said lower wheels, means for driving at least one plurality of said wheels at a desired peripheral speed, and means for biasing said upper plurality of wheels against the lower plurality of wheels to frictionally engage stripped metal sheets therebetween whereby metal deposits are discharged from the chute at a predetermined discharge speed.

31. An apparatus as claimed in claim 28 in which the speed regulating means at the lower horizontal section of the slide rails includes a plurality of lower wheels rotatably mounted in a stationary position transverse of the slide rails, a plurality of opposed upper wheels pivotally mounted for substantially vertical travel above the lower plurality of wheels towards and away from the said lower wheels, means for driving at least one plurality of said wheels at a desired peripheral speed, means for biasing said upper plurality of wheels against the lower plurality of wheels to frictionally engage stripped metal sheets therebetween whereby metal deposits are discharged from the chute at a predetermined discharge speed, and a pusher mechanism for engaging the sheets to positively assist the travel and discharge of the deposits.

* * * * *